US011072887B2

(12) United States Patent
Higuchi et al.

(10) Patent No.: US 11,072,887 B2
(45) Date of Patent: Jul. 27, 2021

(54) CLASSIFYING DEVICE AND FIBROUS FEEDSTOCK RECYCLING DEVICE

(71) Applicant: SEIKO EPSON CORPORATION, Tokyo (JP)

(72) Inventors: Naotaka Higuchi, Fujimi-machi (JP); Yuta Inagaki, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 104 days.

(21) Appl. No.: 16/184,530

(22) Filed: Nov. 8, 2018

(65) Prior Publication Data

US 2019/0136451 A1 May 9, 2019

(30) Foreign Application Priority Data

Nov. 8, 2017 (JP) ..... JP2017-215666

(51) Int. Cl.
*D21D 5/02* (2006.01)
*D21B 1/04* (2006.01)
(Continued)

(52) U.S. Cl.
CPC ..... *D21D 5/02* (2013.01); *B07B 7/06* (2013.01); *B07B 13/16* (2013.01); *D21B 1/04* (2013.01);
(Continued)

(58) Field of Classification Search
USPC ..... 162/261
See application file for complete search history.

(56) References Cited

U.S. PATENT DOCUMENTS 4,797,976 A 1/1989 Leifeld et al.
7,484,624 B2 2/2009 Saika
(Continued)

FOREIGN PATENT DOCUMENTS

CN 204122358 U 1/2015
DE 964 463 C 5/1957
(Continued)

OTHER PUBLICATIONS

JP H07108224, Mizui Katsuya, machine translation, Apr. 1995.*
Apr. 1, 2019 Office Action issued in European Patent Application No. 18205014.6-1019.

*Primary Examiner* — Mark Halpern
(74) *Attorney, Agent, or Firm* — Oliff PLC

(57) ABSTRACT

A compactly configurable device that classifies material containing fiber can more reliably recover classified content. A classifier has a mesh disc with numerous holes, and separates screenings that pass through the holes from remnants that do not pass through; a defibrated material spray nozzle disposed to one side of the mesh disc sprays defibrated material containing fiber onto the mesh disc; a suction conduit disposed to the other side of the mesh disc suctions the waste screenings that pass through the holes; and a recovery conduit disposed on the one side of the mesh disc suctions the processing feedstock that do not pass through the holes and in the mesh disc and remain on the mesh disc. The mesh disc is disposed so the a position of the holes can move from a spraying position opposite the defibrated material spray nozzle to a suction position opposite the recovery conduit. The recovery conduit suctions, at the suction position, processing feedstock that was left at the spraying position.

11 Claims, 14 Drawing Sheets

(51) Int. Cl.

| | |
|---|---|
| ***B07B 13/16*** | (2006.01) |
| ***B07B 7/06*** | (2006.01) |
| *B07B 11/06* | (2006.01) |
| *D21F 9/00* | (2006.01) |

(52) U.S. Cl.
CPC ..... *B07B 11/06* (2013.01); *B07B 2201/04* (2013.01); *D21F 9/00* (2013.01)

(56) References Cited

U.S. PATENT DOCUMENTS

| | | | |
|---|---|---|---|
| 2007/0163924 | A1 | 7/2007 | Saika |
| 2018/0021976 | A1 | 1/2018 | Nakamura |

FOREIGN PATENT DOCUMENTS

| | | | |
|---|---|---|---|
| JP | S62-263328 | A | 11/1987 |
| JP | H07-108224 | A | 4/1995 |
| JP | H09-234428 | A | 9/1997 |
| JP | 2004-261764 | A | 9/2004 |
| JP | 2004-321897 | A | 11/2004 |
| JP | 2005-058876 | A | 3/2005 |
| JP | 2013-147772 | A | 8/2013 |
| JP | 2015-178206 | A | 10/2015 |
| JP | 2016-160562 | A | 9/2016 |
| WO | 2004105966 | A1 | 12/2004 |
| WO | 2016/139885 | A1 | 9/2016 |

* cited by examiner

CLASSIFYING DEVICE AND FIBROUS FEEDSTOCK RECYCLING DEVICE

This application claims priority to Japanese Patent Application 2017-215666 filed Nov. 8, 2017. The disclosure of the prior application is hereby incorporated in its entirety herein.

BACKGROUND

1. Technical Field

The present invention relates to a classifying device and a fibrous feedstock recycling device.

2. Related Art

Devices for classifying material containing fiber are known from the literature. See, for example, JP-A-2015-178206. The sheet manufacturing apparatus described in JP-A-2015-178206 causes defibrated material defibrated from feedstock to hit a sieve with holes, thereby separating screenings that pass through the holes in the sieve from the remnants that do not pass through the holes.

Because the device described in JP-A-2015-178206 separates and recovers the screenings and remnants by the screenings and remnants dropping due to their own weight (gravity), screenings and remnants may accrete on the sieve. The device described in JP-A-2015-178206 is configured to suppress accumulation of remnants in the sieve by having a cleaner for wiping remnants from the sieve, but a simpler configuration is needed to reduce the size of the device.

SUMMARY

The present invention is directed to solving the foregoing objective, and an object of the invention is to provide a device that classifies feedstock containing fiber in a configuration that can be downsized and more reliably recover the separated components.

To achieve the foregoing object, a classifying device according to an aspect of the invention has: a first separator having multiple holes and configured to separate screenings that pass through the holes, and remnants that do not pass through the holes; a first sprayer disposed on one side of the first separator and configured to spray feedstock containing fiber to separate from the one side onto the first separator; a first suction unit disposed on the other side of the first separator and configured to suction the screenings that past through the holes; and a second suction unit disposed on the one side of the first separator, and configured to suction, from the one side of the first separator, the remnants that do not pass through the holes in the first separator and remain on the first separator; the first separator disposed so the position of the holes can move from a first position opposite the first sprayer to a second position opposite the second suction unit; and the second suction unit configured to suction at the second position the remnants left at the first position.

In this configuration, the screenings that pass through the holes in the first separator are suctioned by the first suction unit, and the holes in the first separator move. As a result, remnants that do not pass through the holes in the first separator and remain on the first separator are suctioned by a second suction unit disposed to a position different from the first suction unit. As a result, material contained in the feedstock to be classified can be efficiently separated into screening that pass through the holes and remnants that do not pass through the holes, and reliably recovered, by a compactly configurable and simple device.

A classifying device according to another aspect of the invention preferably also has a second spraying unit disposed to the other side of the first separator, and configured to spray humidified air onto the remnants suctioned by the second suction unit.

By adding moisture to the remnant material, this configuration can prevent accretion of remnants due to static electricity, and can consistently recover and convey the remnants.

A classifying device according to another aspect of the invention preferably also has a humidified air supply device configured to supply humidified air to a space containing the first separator.

By adding moisture to the remnants and screenings, this configuration can prevent accretion of remnants and screenings due to static electricity, and can consistently recover and convey the desired remnants.

A classifying device according to another aspect of the invention preferably also has a wetting device configured to add moisture to the first separator between the first position and the second position.

By adding moisture to the remnants that did not pass through the holes in the first separator at the first position and are suctioned at the second position, this configuration can prevent accretion of remnants due to static electricity, and can efficiently recover the remnants by the second suction unit.

In a classifying device according to another aspect of the invention, the first separator is a plate member that rotates, and the first position and second position are offset to one side from the axis of rotation of the first separator.

This configuration can make the distance the remaining material left on the first separator travels from the first position to the second position greater than half of one rotation in the direction the first separator turns. As a result, the remnants are left on the first separator and humidified for a sufficient time, and the effects of static electricity can be more effectively suppressed.

In a classifying device according to another aspect of the invention, the first sprayer and the first suction unit are disposed in opposition with the first separator therebetween, and an area of an opening of the first suction unit to the surface of the first separator is greater than an area of an opening of the first sprayer to the surface of the first separator.

This configuration can suction most of the screenings that pass through the holes in the first separator by means of the first suction unit, and the amount of screenings that are not suctioned by the first suction unit can be suppressed. As a result, screenings can be efficiently recovered, and dispersion of the screenings can be suppressed.

A classifying device according to another aspect of the invention preferably also has: a second separator disposed between the first separator and the first suction unit, and having holes smaller than the holes in the first separator; and a third suction unit disposed to the opposite side of the second separator as the first suction unit. The second separator is disposed so the position of the holes can move from a third position opposite the first suction unit to a fourth position opposite the third suction unit; and the third suction unit is configured to suction at the fourth position the remnants of the screenings that pass through the holes in the first separator but do not pass the holes in the second separator and are left on the second separator.

This configuration can separate and recover, from the components of the feedstock to be classified, components that do not pass through the holes in the first separator, components that pass through the holes in the first separator and do not pass through the holes in the second separator, and screenings that pass through the holes in the second separator. As a result, components contained in the feedstock to be classified can be separated by size, and the components can be efficiently and reliably recovered, by a compactly configurable, simple device.

In a classifying device according to another aspect of the invention, the third suction unit is disposed to a position not overlapping the second suction unit in the suction direction.

This configuration can separate and recover components that do not pass through the holes in the first separator, and components that pass through the holes in the first separator and do not pass through the holes in the second separator.

A classifying device according to another aspect of the invention preferably also has a third spraying unit disposed to the second separator on the same side as the first suction unit, and configured to spray humidified air onto the remnants the third suction unit suctions.

By adding moisture to the remnant material that is suctioned by the third suction unit, this configuration can prevent accretion of remnants due to static electricity, and can consistently recover and convey the remnants.

In a classifying device according to another aspect of the invention, the third spraying unit and the third suction unit are disposed in opposition with the second separator therebetween, and an area of an opening of the third suction unit to the surface of the second separator is greater than an area of an opening of the third sprayer to the surface of the second separator.

This configuration can suction, by the third suction unit, most of the air emitted by the third spraying unit, and the remnants can be efficiently recovered by the air current flowing from the third spraying unit to the third suction unit.

Another aspect of the invention is a fibrous feedstock recycling device including: a defibrator configured to defibrate feedstock containing fiber; a classifier configured to separate processing feedstock from defibrated material that was defibrated by the defibrator; and a sheet forming unit configured to form the processing feedstock separated by the classifier into a sheet form. The classifier includes a first separator having multiple holes and configured to separate screenings that pass through the holes, and remnants that do not pass through the holes; a first sprayer disposed on one side of the first separator and configured to spray the defibrated material from the one side onto the first separator; a first suction unit disposed on the other side of the first separator and configured to suction the screenings that past through the holes; and a second suction unit disposed on the one side of the first separator, and configured to suction, from the one side of the first separator, the remnants that do not pass through the holes in the first separator and remain on the first separator; the first separator disposed so the position of the holes can move from a first position opposite the first sprayer to a second position opposite the second suction unit; the second suction unit configured to suction at the second position the remnants left at the first position; and the fibrous feedstock recycling device conveying the remnants suctioned by the second suction unit to the sheet forming unit.

In this configuration, the first separator efficiently separates the defibrated material into screenings that pass through holes in the first separator, and remaining material (remnants) that do not pass through the holes, and can recover the remnants as feedstock for subsequent processing (processing feedstock). As a result, processing feedstock that is formed into sheets can be reliably extracted and recovered from defibrated material by a compactly configurable classifier. Feedstock containing fiber can therefore be efficiently recycled by means of a compact configuration.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of the invention are described below with reference to the accompanying figures. Note that the embodiments described below do not limit the content of the embodiments described in the accompanying claims. All configurations described below are also not necessarily essential elements of the invention.

1. Embodiment 1

1-1. General Configuration of a Sheet Manufacturing Apparatus

Figure 1:
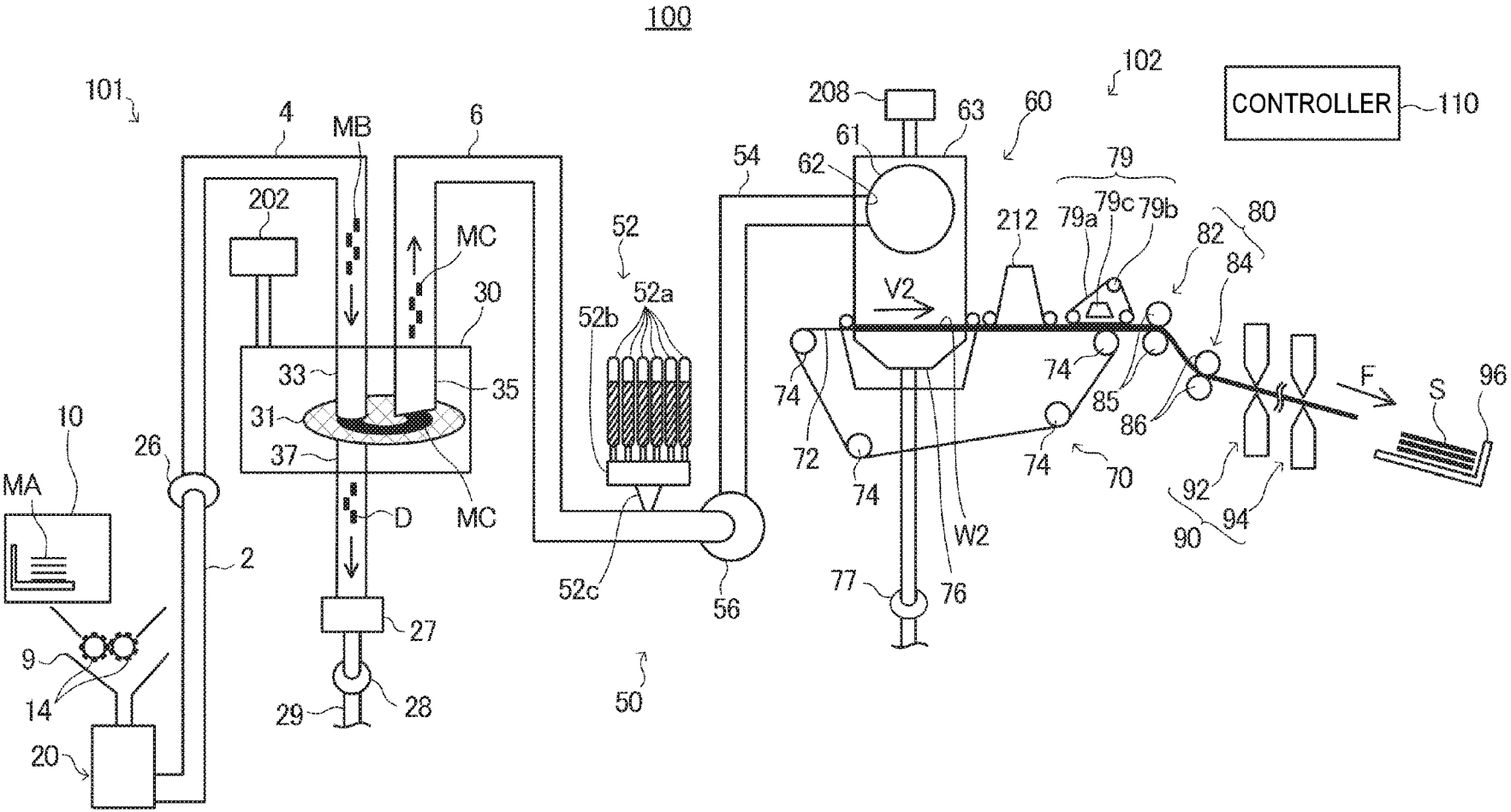
FIG. 1 illustrates the general configuration of a sheet manufacturing apparatus according to a first embodiment of the invention.

FIG. 1 schematically illustrates the configuration of a sheet manufacturing apparatus 100 according to a first embodiment of the invention.

The sheet manufacturing apparatus 100 according to the invention is an example of a fibrous feedstock recycling device, and executes a recycling process of defibrating feedstock containing fiber (fibrous feedstock) into individual fibers, and then making new sheets from the fiber material.

The sheet manufacturing apparatus 100 manufactures various types of sheets by defibrating feedstock in a dry process into individual fibers, and then compressing, heating, and cutting. By mixing various additives to the defibrated material, the sheet manufacturing apparatus 100 can also improve the binding strength and whiteness of the sheet, and impart desirable characteristics such as color, scent, and flame resistance. By controlling the density, thickness, and form of the paper, the sheet manufacturing apparatus 100 can also produce various kinds of sheets. Examples of such sheets include A4 and A3 size office paper, cleaning sheets (such as sheets for sweeping floors), sheets for absorbing oil, and sheets for cleaning toilets, and molded sheet such as paper plates.

The sheet manufacturing apparatus 100 has a supply device 10, shredder 12, defibrator 20, classifier 30 (separating device), mixing device 50, additive supply device 52, air-laying device 60 (accumulator), web forming device 70, conveyance device 79, sheet forming device 80, and cutting device 90. The sheet manufacturing apparatus 100 also has a controller 110 that controls parts of the sheet manufacturing apparatus 100.

The sheet manufacturing apparatus 100 has multiple wetting units (humidifiers) for wetting (humidifying) the feedstock, and/or wetting (humidifying) the spaces through which the feedstock travels. Wetting devices 202, 208, 212 are shown as an example of a wetting device. Note that the specific configuration of the wetting devices 202, 208, and 212 may be designed as desired, and steam, evaporative, warm air vaporization, ultrasonic, or other type of humidification method may be used.

In this embodiment, wetting devices 202, 208 are evaporative or warm air vaporization humidifiers. The wetting devices 202, 208 have a filter (not shown in the figure) that is wetted with water, and supply humidified air with a high humidity level by passing air through the filter.

Wetting device 212 is an ultrasonic humidifier, produces mist by atomizing water, and supplies the resulting mist.

The supply device 10 supplies to the shredder 12 feedstock MA the sheet manufacturing apparatus 100 recycles into sheets.

The feedstock MA is material containing fiber, and may be, for example, paper, pulp, pulp sheets, cloth, including nonwoven cloth, or textiles, for example. The feedstock of the sheet manufacturing apparatus 100 may be used paper, waste paper, or other types of recovered paper, or unused (virgin) paper. The sheet manufacturing apparatus 100 described below uses recovered paper (including waste paper) as the feedstock.

The supply device 10 has a tray (not shown in the figure) for holding the feedstock MA loaded by the user, a roller (not shown in the figure) that feeds the feedstock MA from the tray, and a motor (not shown in the figure) that drives the roller. The supply device 10 supplies the feedstock MA to the shredder 12 by operating the motor.

The shredder 12 has a pair of shredder blades 14 that shred the feedstock MA supplied from the supply device 10 to between the shredder blades 14, and a chute (also referred to as a hopper) 9 that receives the paper shreds cut by and falling from the shredder blades 14. The shredder 12 shreds (cuts) the feedstock MA supplied from the supply device 10 in air by means of the shredder blades 14, producing coarse shreds. The shredder 12 in this example has the configuration of a common paper shredder, for example. The shape and size of the shreds is not specifically limited and is suitable to the defibrating process of the defibrator 20. In this example, the shredder 12 cuts the feedstock MA into shreds approximately one to several centimeters square or smaller.

The chute 9 has a tapered shape with a width that gradually narrows in the direction the shreds flow (the downstream direction), and connects to the defibrator 20. The shreds cut by the shredder blades 14 are collected by the chute 9 and conveyed (transported) to the defibrator 20.

A configuration that supplies wet (humidified) air by means of a wetting device 202 to suppress electrostatic accumulation of shreds may be provided to or near the chute 9. Alternatively, an ionizer may be disposed as a static eliminator to the shredder 12 and defibrator 20.

The defibrator 20 defibrates the shreds produced by the shredder 12, and outputs defibrated material MB.

As used herein, defibrate means to break apart and detangle feedstock (in this example, shreds or other undefibrated fibrous material) composed of many fibers bonded together into single individual fibers. The defibrator 20 also has the ability to separate from the fibers various materials adhering to (bonded with) the feedstock, such as resin particles, ink toner, and bleeding inhibitors. The material that has passed through the defibrator 20 is referred to as defibrated material, identified as defibrated material MB below. In addition to defibrated fiber, the defibrated material MB contains additives that are separated from the fiber during defibration, including resin (resin bonding multiple fibers together), ink, toner, and other color additives, bleeding inhibitors, and strengthening agents. These fibers, color materials, and additives are components included in the feedstock MA. The shape of the fiber in the defibrated material MB may be as strings or ribbons. The fiber contained in the defibrated material MB may be as individual fibers not intertwined with other fibers, or as clumps, which are multiple fibers tangled together with other defibrated material MB into clumps.

The defibrator 20 defibrates in a dry process. A dry process as used herein means that the defibration process is done in air instead of a wet solution. The defibrator 20 uses an impeller mill in this example. More specifically, the defibrator 20 has a rotor (not shown in the figure) that turns at high speed, and a liner (not shown in the figure) positioned around the outside of the rotor. The shreds produced by the shredder 12 in this configuration go between the rotor and the liner of the defibrator 20 and are defibrated.

The defibrator 20 produces an air current by rotation of the rotor. By this air current the defibrator 20 suctions the shreds, and conveys the defibrated material MB downstream. The defibrated material MB is delivered through the conduit 2 to the classifier 30.

The sheet manufacturing apparatus 100 also has a defibrator blower 26 as an air current generator. The defibrator blower 26 is disposed to the conduit 2, and suctions and pushes air with the defibrated material MB from the defibrator 20 to the classifier 30. The defibrated material MB is conveyed to the classifier 30 by the air current produced by the defibrator 20 and the air current produced by the defibrator blower 26.

The classifier 30 classifies the defibrated material MB inflowing from the conduit 2 by size. More specifically, the defibrator 20 separates the defibrated material MB into feedstock for processing (referred to below as processing feedstock) MC that is greater than or equal to a predetermined size, and waste D that is smaller than the predetermined size.

The waste D contains particles of color agents and other additives as described above, short fibers that are not suited for recycling into new sheets S as described below, and is not used to make new sheets S.

The processing feedstock MC contains primarily fiber, and consists primarily of fibers with a length suitable to making sheets S. In other words, the classifier 30 separates the defibrated material MB into processing feedstock MC containing fiber suitable as material for making sheets S, and waste D, which is material not suitable for making sheets S.

The classifier 30 has a mesh disc 31 that has numerous holes of a specific size and functions as a screen (sieve), and a defibrated material spray nozzle 33 (first spraying unit) for spraying the defibrated material MB (defibration material) onto the mesh disc 31. Of the defibrated material MB sprayed by the defibrated material spray nozzle 33, particulate and fiber smaller than the holes in the mesh disc 31 pass through the holes in the mesh disc 31. The classifier 30 also has a suction conduit 37 (first suction unit) that suctions the waste D, which is the particulate that passes through the holes in the mesh disc 31.

Of the materials contained in the defibrated material MB, fiber of sizes that will not pass through the holes in the mesh disc 31 are left on the mesh disc 31 without passing through the holes in the mesh disc 31. The classifier 30 also has a recovery conduit 35 (second suction unit) that suctions the processing feedstock MC (remaining material) left on the mesh disc 31. The recovery conduit 35 connects to the mixing blower 56 through another conduit 6, and processing feedstock MC left on the mesh disc 31 is suctioned and recovered by the suction force of the mixing blower 56.

The defibrated material MB defibrated by the defibrator 20 is thus separated by the classifier 30 into processing feedstock MC and waste D, and the processing feedstock MC is conveyed through the conduit 6 to the mixing blower 56.

The suction conduit 37 connects to the dust collector 27, and a collection blower 28 is disposed on the downstream side of the dust collector 27. The collection blower 28 pulls air from the dust collector 27, and waste D that has passed through the holes in the mesh disc 31 is suctioned by the suction force of the collection blower 28 through the dust collector 27.

The dust collector 27 is a filter-type or cyclonic dust collector, and separates particulates from the air current. The waste D suctioned with air by the suction force of the collection blower 28 is captured by the dust collector 27. The dust collector 27 in this example has a filter (not shown in the figure), and the waste D is captured by the filter of the dust collector 27. Air that passes through the dust collector 27 is discharged through the conduit 29.

The classifier 30 also has a wetting device 202 (humidified air supply device). The wetting device 202 humidifies the space including the mesh disc 31 and the defibrated material spray nozzle 33, recovery conduit 35, and suction conduit 37 disposed to the mesh disc 31. By supplying humidified air (conditioned air) from the wetting device 202 to the space including the mesh disc 31, the moisture content of the waste D and processing feedstock MC separated by the mesh disc 31 is adjusted. As a result, the effects of static electricity can be suppressed, and processing feedstock MC left on the mesh disc 31, for example, can be easily separated from the mesh disc 31 by the suction from the recovery conduit 35. In addition, processing feedstock MC sticking to the inside of the recovery conduit 35 and conduit 6, and waste D sticking to the inside of the suction conduit 37, due to static electricity can be suppressed.

The mixing device 50 has an additive supply device 52 that supplies an additive including resin, a conduit 54 through which a current carrying the processing feedstock MC separated by the classifier 30 flows, and a mixing blower 56, and mixes an additive including resin with the processing feedstock MC.

One or more additive cartridges 52*a* storing additives are installed to the additive supply device 52. The additive cartridges 52*a* are removably installed to the additive supply device 52. The additive supply device 52 includes an additive extractor 52*b* that extracts additive from the additive cartridges 52*a*, and an additive injector 52*c* that discharges the additive extracted by the additive extractor 52*b* into the conduit 54.

The additive extractor 52*b* has a feeder (not shown in the figure) that feeds additive in a powder or particulate form from inside the additive cartridges 52*a*, and removes additive from some or all of the additive cartridges 52*a*. The additive removed by the additive extractor 52*b* is conveyed to the additive injector 52*c*.

The additive injector 52*c* holds the additive removed by the additive extractor 52*b*. The additive injector 52*c* has a shutter (not shown in the figure) that opens and closes the connection to the conduit 54, and when the shutter is open, the additive extracted by the additive extractor 52*b* is injected to the conduit 54.

The shutter of the additive injector 52*c* has the effect of preventing excessive additive from being suctioned from the additive supply device 52 by the negative pressure produced by the air flow through the conduit 54.

The additive that the additive supply device 52 supplies includes resin that melts and binds multiple fibers together when heated. The resin contained in the additive may be a thermoplastic resin or thermoset resin, such as AS resin, ABS resin, polypropylene, polyethylene, polyvinyl chloride, polystyrene, acrylic resin, polyester resin, polyethylene terephthalate, polyethylene ether, polyphenylene ether, polybutylene terephthalate, nylon, polyimide, polycarbonate, polyacetal, polyphenylene sulfide, and polyether ether ketone. These resins may be used individually or in a desirable combination. The additive may contain only a single material or a mixture, both of which may comprise multiple types of particulate comprising a single or multiple materials. The additive supplied may also be a fibrous or powder form.

In addition to resin for binding fibers, and depending on the type of sheet being manufactured, the additive supplied from the additive supply device 52 may also include a coloring agent for coloring the fiber, an anti-blocking agent to prevent agglomeration of fibers and agglomeration of resin, or a flame retardant for making the fiber difficult to burn, for example. The additive not containing a coloring agent may be colorless or a color light enough to be considered colorless, or white.

The types and numbers of additives used in the sheet manufacturing apparatus 100 are not specifically limited, and additive cartridges 52*a* corresponding to the types of additives used are installed to the additive supply device 52. The sheet manufacturing apparatus 100 may also use only one, some, or use all, of the additive cartridges 52*a* installed to the additive supply device 52.

In this example, six additive cartridges 52*a* are installed to the additive supply device 52. The six additive cartridges 52*a* include an additive cartridge 52*a* holding a colorless additive or an additive of a nearly-colorless pale color, and an additive cartridge 52*a* holding an additive that colors the fiber white. There are also additive cartridges 52*a* holding additives for coloring the fibers C (cyan), M (magenta), and Y (yellow).

The amount of additive the additive extractor 52*b* extracts from each of the additive cartridges 52*a* is controlled by the controller 110. By the controller 110 controlling the additive supply device 52, the sheet manufacturing apparatus 100 can operate to manufacture sheets S without coloring the fiber contained in the processing feedstock MC, and operate to color the fiber used to manufacture sheets S. By supplying additive from any one of the color additive cartridges 52*a*, fibers can be colored white, cyan, magenta, or yellow. For example, whiteness can be improved by mixing fibers with white additive. Additive supplied from multiple additive cartridges 52*a* can also be mixed to produce fibers of desirably blended colors.

The additive supplied from the additive supply device 52 is conveyed through the conduit 54 and mixed with the fiber in the processing feedstock MC by the air current produced by the mixing blower 56, and passes through the mixing blower 56. The processing feedstock MC is detangled into individual fibers while flowing through conduit 6 and conduit 54. The fibers in the processing feedstock MC and the additive from the additive supply device 52 are mixed by the air current produced by the mixing blower 56 and/or the action of the blades or other rotating members of the mixing blower 56, and the mixture is conveyed through the conduit 54 to the air-laying device 60.

The mechanism that mixes the processing feedstock MC and additive is not specifically limited, and may be configured by mixing with blades rotating at a high speed. A mechanism that uses rotation of the container, such as a V mixer, may also be used, and the mixing mechanism may be disposed before or after the mixing blower 56.

The mixture that has passed the mixing device 50 is introduced from the inlet 62 to the air-laying device 60. The air-laying device 60 detangles and disperses the tangled defibrated material (fiber) in air, causing the mixture to fall onto the web forming device 70. When the resin in the additive supplied from the additive supply device 52 is fibrous, the resin fibers are also detangled by the air-laying device 60 and fall onto the web forming device 70.

The air-laying device 60 has a drum 61 and a housing 63 that houses the drum 61. The drum 61 is a cylindrical structure with mesh, which may be a filter or screen, for example, and functions as a sieve. The mesh of the drum 61 may be a metal screen, expanded metal made by expanding a metal sheet with slits formed therein, or punched metal having holes formed by a press in a metal sheet, for example. The drum 61 is driven rotationally by a motor, and functions as a sieve.

Note that the sieve of the drum 61 may be configured without functionality for selecting specific material. More specifically, the sieve used in the drum 61 means a device having mesh, and the drum 61 may cause all of the mixture introduced to the drum 61 to precipitate from the drum 61.

A web forming device 70 is disposed below the drum 61. The web forming device 70 includes, for example, a mesh belt 72, rollers 74, and a suction mechanism 76.

The mesh belt 72 is an endless belt, is tensioned by multiple rollers 74, and by operation of the tension rollers 74 is driven in the direction indicated by the arrow V2 in the figure. The mesh belt 72 may be metal, plastic, cloth, or nonwoven cloth. The surface of the mesh belt 72 is a screen with an array of openings of a specific size. Of the fiber and particulate dropping from the air-laying device 60, particles of a size that passes through the mesh drop through the mesh belt 72. Fiber of a size that cannot pass through the openings in the mesh accumulates on the mesh belt 72 and is conveyed in the direction of arrow V2 with the mesh belt 72. The mesh in the mesh belt 72 is fine, and is sized so that the majority of the fiber and particles that drop from the drum 61 cannot pass through the mesh belt 72. This configuration causes material that has passed through the mesh of the drum 61 to accumulate in the web forming device 70, and the accumulated material forms a web W2.

The suction mechanism 76 includes a suction blower 77 disposed below the mesh belt 72, and by the suction of the suction blower 77 produces a flow of air from the air-laying device 60 to the mesh belt 72.

The suction mechanism 76 pulls the mixture distributed in air by the air-laying device 60 onto the mesh belt 72, thereby promoting formation of a web W2 on the mesh belt 72. The suction mechanism 76 also has the effect of increasing the discharge rate from the air-laying device 60, and by creating a downward air current in the descent path of the mixture, can prevent interlocking of defibrated material and additive while descending to the mesh belt 72.

The suction blower 77 may be configured to pass air suctioned from the suction mechanism 76 through a collection filter not shown before being discharged to the outside of the sheet manufacturing apparatus 100. Alternatively, the suction blower 77 may push the suctioned air to the dust collector 27 to collect the impurities contained in the air suctioned by the suction mechanism 76.

Humidified air is supplied by the wetting device 208 to the space surrounding the drum 61. As a result, the inside of the air-laying device 60 can be humidified by the humidified air, fiber and particles accumulating on the housing 63 due to static electricity can be suppressed, fiber and particles can be made to fall quickly onto the mesh belt 72, and a web W2 of a desired form can be made.

Air carrying mist is supplied by the wetting device 212 to the conveyance path of the mesh belt 72 on the downstream side of the air-laying device 60. As a result, the water content of the web W2 can be adjusted, and accretion of fiber on the mesh belt 72 due to static electricity is also suppressed.

The web W2 formed by the air-laying device 60 and web forming device 70 is then separated from the mesh belt 72 and conveyed to the sheet forming device 80 by a conveyance device 79. The conveyance device 79 includes, for example, a mesh belt 79*a*, rollers 79*b*, and a suction mechanism 79*c*.

The suction mechanism 79*c* includes a blower (not shown in the figure), and by the suction force of the blower produces an upward air current on the mesh belt 79*a*. As a result of this air current, the web W2 separates from the mesh belt 72 and is pulled to the mesh belt 79*a*. The mesh belt 79*a* moves in conjunction with the rollers 79*b*, and conveys the web W2 to the sheet forming device 80.

The sheet forming device 80 binds fibers in the mixture through the resin contained in the additive by applying heat to the fiber and additive contained in the web W2.

More specifically, the sheet forming device 80 has a compression device 82 that compresses the web W2, and a heating device 84 that heats the web W2 after the web W2 is compressed by the compression device 82.

The compression device 82 in this example comprises a pair of calender rolls 85 that hold the web W2 with a specific nipping force, compress the web W2 to a high density, and convey the compressed web W2 to the heating device 84.

The heating device 84 has a pair of heat rollers 86 which heat the web W2 as it passes between the heat rollers 86 after being compressed by the calender rolls 85, forming a sheet S.

The cutting device 90 cuts the sheet S formed by the sheet forming device 80. In this example, the cutting device 90 has a first cutter 92 that cuts the sheet S crosswise to the conveyance direction of the sheet S indicated by the arrow F in the figure, and a second cutter 94 that cuts the sheet S parallel to the conveyance direction F. Single sheets of a specific size are formed by cutting the web W2 in this way. The single sheets S cut by the cutting device 90 are then stored in the discharge tray 96. The discharge tray 96 may be a tray or stacker for holding the manufactured sheets, and the sheets S discharged to the tray can be removed and used by the user.

Parts of the sheet manufacturing apparatus 100 are configured as a defibration process unit 101 and recycling unit 102.

The defibration process unit 101 comprises at least the supply device 10 and defibrator 20, and may include the classifier 30. The defibration process unit 101 produces defibrated material MB from the feedstock MA, or produces processing feedstock MC separated from the defibrated material MB. The defibration process unit 101 may also be provided separately from the sheet manufacturing apparatus 100. The output product of the defibration process unit 101 may be (removed from the sheet manufacturing apparatus 100 where provided and) stored. The output product may also be sealed in specific packages, which may then be shipped and sold (marketed).

The recycling unit 102 is a functional unit that manufactures the product produced by the defibration process unit 101 into sheets S, includes the mixing device 50, web forming device 70, conveyance device 79, sheet forming device 80, and cutting device 90, and may include an additive supply device 52.

The sheet manufacturing apparatus 100 may also be configured with the defibration process unit 101 and recycling unit 102 in an integrated system, or as separate devices. In this case, the defibration process unit 101 is an example of a fibrous feedstock recycling device according to the invention, and the recycling unit 102 is an example of a sheet forming device that forms defibrated material into sheets.

The operation of supplying feedstock MA by the supply device 10 is an example of a supply process. Likewise, the operation of the defibrator 20 is an example of a defibration process, the operation of the classifier 30 is an example of a classification process, the operation of the additive supply device 52 is an example of an additive supply process, and the operation of the mixing device 50 is an example of a mixing process. The operation of the air-laying device 60 is an example of an air-laying (deposition) process, the operation of the web forming device 70 is an example of a web forming process, and the operation of the conveyance device 79 is an example of a conveyance process. The operation of the sheet forming device 80 is an example of a sheet forming process, and the operation of the compression device 82 is an example of a compression (calendering) process, and the operation of the heating device 84 is an example of a heating process. The operation of the cutting device 90 is an example of a cutting process.

1-2. Classifier Configuration

Figure 2:
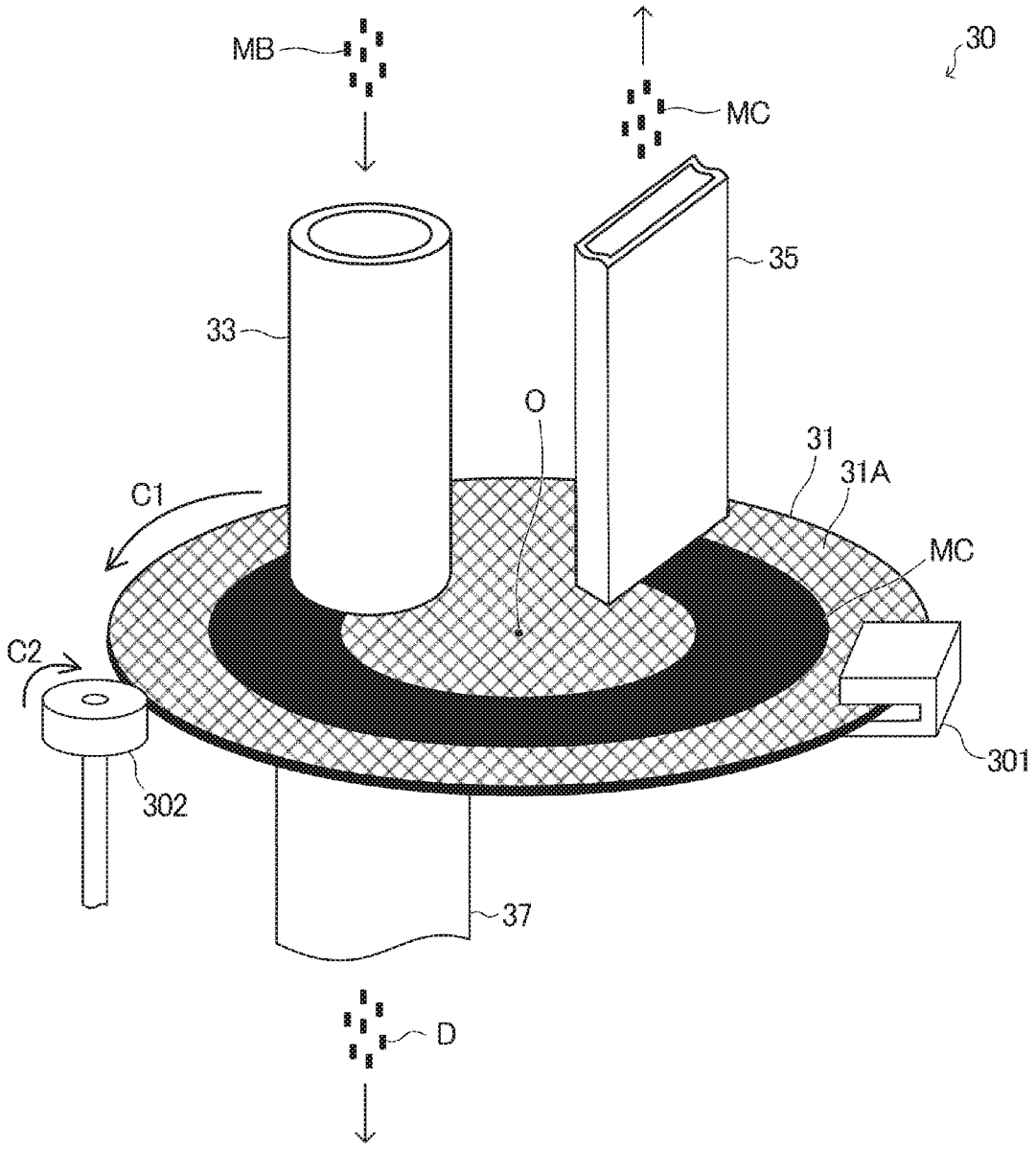
FIG. 2 is an oblique view of the main parts of the classifier in the first embodiment of the invention.
Figure 3:
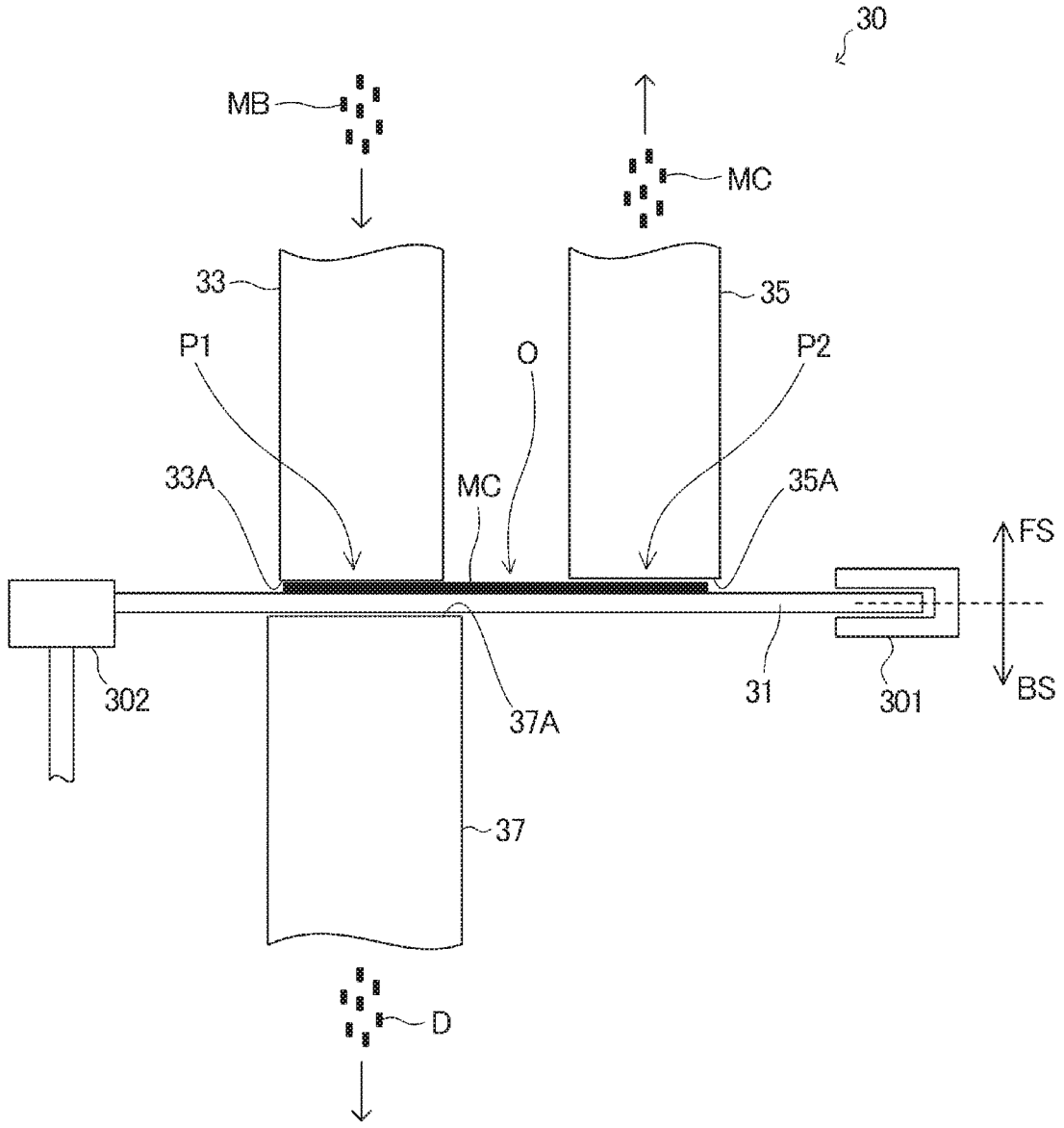
FIG. 3 is a side view of the main parts of the classifier in the first embodiment of the invention.
Figure 4:
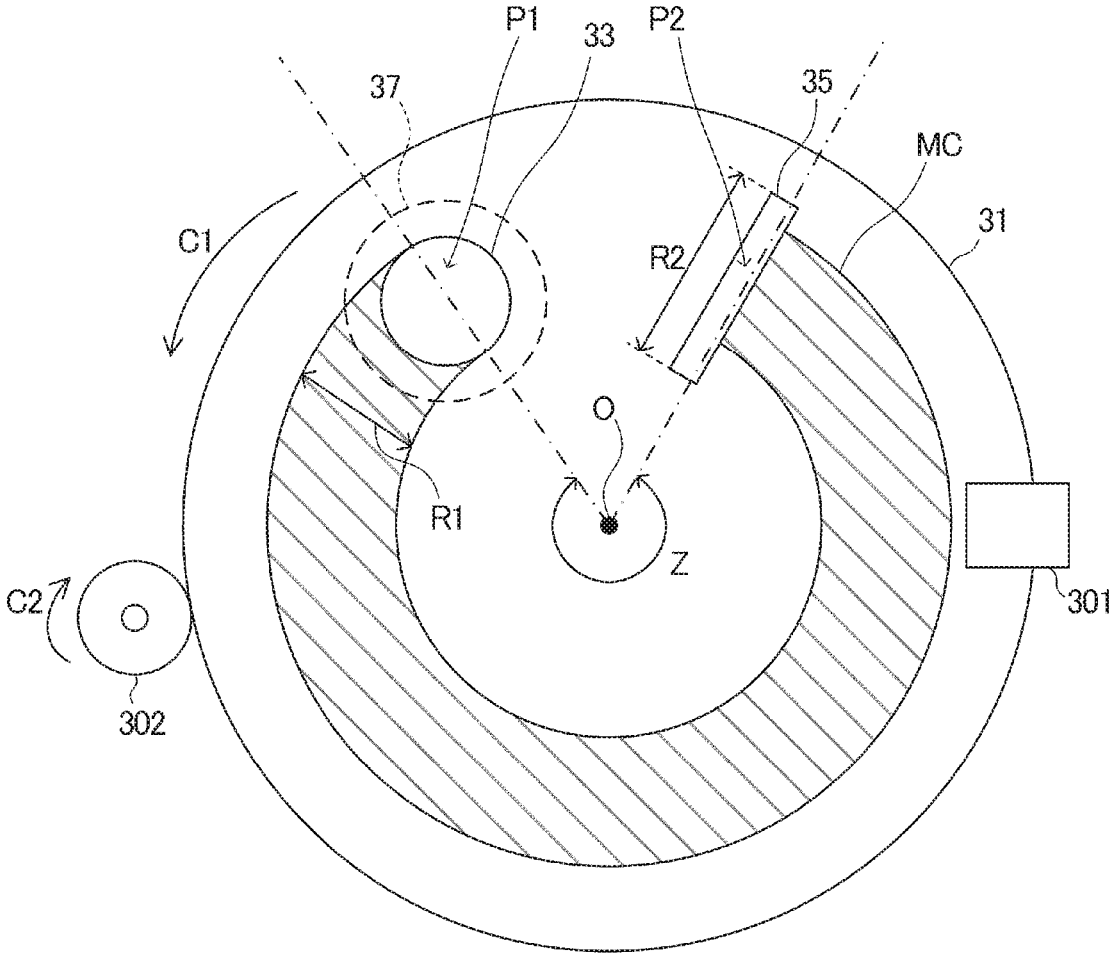
FIG. 4 is a plan view of the main parts of the classifier in the first embodiment of the invention.

FIG. 2 is an oblique view of the main parts of the classifier 30 according to the first embodiment of the invention. FIG. 3 is a side view of the main parts of the classifier 30, and FIG. 4 is a plan view of the main parts of the classifier 30, showing the classifier 30 from the front side FS of the mesh disc 31.

As shown in FIG. 2 and FIG. 3, the mesh disc 31 is a flat plate member with numerous holes 31A, and more specifically is a round disc-shaped structure. The mesh disc 31 functions as a filter or sieve with numerous holes 31A. The mesh disc 31 may be made of metal or plastic, and may be a metal screen, expanded metal made by expanding a metal sheet with slits formed therein, or punched metal having holes formed by a press in a metal sheet, for example. The size of the holes 31A is not specifically limited, and in this example the holes are openings of a size of approximately 0.1 mm. The shape of the holes 31A is not specifically limited, and the holes 31A may be openings formed as spaces between multiple wires, or holes formed in a flat panel such punched metal. The holes 31A may also be polygonal, round, or oval. The size of the holes 31A can be defined as the width of the longest part of the opening.

The shape of the mesh disc 31 is also not limited to round, and may be oval, rectangular, or other geometric shape, and may be an asymmetrical shape, but in the most typical practical configuration it is round.

The classifier 30 has a support member 301 configured to support the outside edge part of the mesh disc 31, and a driver 302 configured to contact the outside edge of the mesh disc 31 and drive the mesh disc 31. The support member 301 supports the mesh disc 31 rotationally on axis of rotation O. The driver 302 is a roller that turns in contact with the outside edge of the mesh disc 31, is driven by a motor not shown, and turns in the direction indicated by arrow C2. When the driver 302 turns, the mesh disc 31 also rotates in the direction indicated by arrow C1. The speed of the driver 302 and the mesh disc 31 may be desirably set, and may be controlled by the controller 110 (FIG. 1), for example.

The mesh disc 31 is disposed so that it is horizontal when the sheet manufacturing apparatus 100 is set up in the operating position. The mesh disc 31 may, however, be disposed to any desired angle, including vertically (parallel to the vertical plane), or at a desirable angle to the level horizontal plane.

In this embodiment, the processing feedstock MC deposited on the mesh disc 31 can preferably remain for a specific continuous time. As a result, the mesh disc 31 in this embodiment is preferably disposed horizontally or at a nearly horizontal angle. The angle of the mesh disc 31 is held constant by the support member 301 supporting the mesh disc 31.

The configuration for supporting and rotating the mesh disc 31 is not limited to a support member 301 and driver 302 as described above. For example, the mesh disc 31 may be mounted with a rotating spindle passing through the axis of rotation O, and the rotating spindle may be configured to support and drive the mesh disc 31 rotationally.

The defibrated material spray nozzle 33, recovery conduit 35, and suction conduit 37 are disposed substantially vertically. The defibrated material spray nozzle 33, recovery conduit 35, and suction conduit 37 may be set to a desired angle, but preferably directly face the surface of the mesh disc 31. As shown in FIG. 3, the defibrated material spray nozzle 33 and recovery conduit 35 are disposed on the front side FS of the mesh disc 31, and the suction conduit 37 is disposed on the back side BS of the mesh disc 31. Note that if the front side FS is one side of the mesh disc 31, the back side BS is the other side.

The defibrated material spray nozzle 33 is a hollow tube, the bottom end of the defibrated material spray nozzle 33 is cut substantially horizontally, forming an open end 33A, and the space inside the defibrated material spray nozzle 33 opens at the open end 33A. The recovery conduit 35 and suction conduit 37 are likewise hollow tubes, the space inside the recovery conduit 35 opens through an open end 35A formed at the bottom end of the recovery conduit 35, and the space inside the suction conduit 37 is open through the open end 37A formed at the top end of the suction conduit 37. Open ends 33A, 35A face the front side FS of the mesh disc 31, and open end 37A faces the back side BS of the mesh disc 31.

The suction conduit 37 is disposed opposite the defibrated material spray nozzle 33 with the mesh disc 31 therebetween.

The defibrated material MB conveyed by the air current inside the defibrated material spray nozzle 33 is sprayed from the open end 33A onto the mesh disc 31. The suction conduit 37 opposite the defibrated material spray nozzle 33 pulls air from the open end 37A by means of the suction produced by the collection blower 28 (FIG. 1). As a result, of the components of the defibrated material MB, particulates and fiber that can pass through the holes 31A passes through the holes 31A and are suctioned from the open end 37A into the suction conduit 37.

As shown in FIG. 3, open ends 33A, 35A, 37A are disposed close to the surface of the mesh disc 31. Open ends 33A, 35A are disposed facing the front side FS of the mesh disc 31 with a gap sufficient to prevent contact with the processing feedstock MC on the mesh disc 31. Open end 37A is disposed with a gap sufficient to prevent interference with the rotation of the mesh disc 31 in the direction of arrow C1, that is, so that the open end 37A does not contact the mesh disc 31.

Of the components of the defibrated material MB sprayed from the open end 33A, fiber and other material that does not pass through the holes 31A accumulates on the front side FS of the mesh disc 31. This material is referred to as the processing feedstock MC described above. The processing feedstock MC sticks to the mesh disc 31 directly below the open end 33A, and moves with rotation of the mesh disc 31.

As shown in FIG. 3 and FIG. 4, the defibrated material spray nozzle 33 and recovery conduit 35 are disposed to separate positions above the mesh disc 31. The processing feedstock MC sprayed from the open end 33A to the mesh disc 31 moves in an arc in conjunction with rotation of the mesh disc 31. Open end 35A is open to the path of processing feedstock MC travel, and the processing feedstock MC carried on the mesh disc 31 is suctioned through the recovery conduit 35 by means of the suction produced by the mixing blower 56 (FIG. 1).

The position where the open end 33A opposes the mesh disc 31 is referred to as spraying position P1 (first position), and the position where the open end 35A opposes the mesh disc 31 is referred to as suction position P2 (second position). The processing feedstock MC is blown onto the mesh disc 31 at the spraying position P1, moves in an arc to the suction position P2 with rotation of the mesh disc 31, and is suctioned at the suction position P2.

As shown in FIG. 4, the path of processing feedstock MC movement is an arc centered on the axis of rotation O and starting from the spraying position P1. The suction position P2 is another position on the arc of processing feedstock MC movement. The distance from the axis of rotation O to the spraying position P1 is therefore substantially equal to the distance from the axis of rotation O to the suction position P2. In other words, the spraying position P1 and the suction position P2 are both located in respective radii of the mesh disc 31, and the distances thereto from the axis of rotation O of the mesh disc 31 are substantially equal.

In this example, the distance from the axis of rotation O to the spraying position P1 may be defined as the distance from the axis of rotation O to the center of the spraying position P1. Likewise, the distance from the axis of rotation O to the suction position P2 may be defined as the distance from the axis of rotation O to the center of the suction position P2.

The width of the path of processing feedstock MC movement in the radial direction of the circle centered on the axis of rotation O is width R1. This width R1 is equivalent to the open width of the open end 33A of the defibrated material spray nozzle 33. Because the defibrated material spray nozzle 33 in this embodiment is described as a round tube, the shape of the opening of the open end 33A is also round. In other examples, the shape of the opening of the open end 33A may be polygonal or elliptical, in which case the opening is preferably largest in the circumferential direction centered on the axis of rotation O. In this case, processing feedstock MC and waste D can be more reliably separated by dispersing the defibrated material MB over a wide area of the mesh disc 31.

The opening of the recovery conduit 35 has an open width R2 that is greater than width R1 in the radial direction of a circle centered on the axis of rotation O. The opening to the recovery conduit 35 in this embodiment is rectangular with width R2 being the long side. The shape of the opening to the recovery conduit 35 is not specifically limited, and may be round, elliptical, or polygonal, but preferably has a large width R2 and a small open area. As a result, the opening of the recovery conduit 35 is preferably a rectangle with a long side of width R2, or an ellipse with a long diameter of width R2. The open area of the recovery conduit 35 affects the speed of the suction current through the opening to the recovery conduit 35. In other words, if the open area is small, the speed of the air current through the open end 35A is fast. Therefore, by decreasing the open area of the recovery conduit 35, the speed of the suction current pulling the processing feedstock MC from the mesh disc 31 can be increased, and the processing feedstock MC can be reliably suctioned and recovered without leaving material on the mesh disc 31.

As shown in FIG. 4, both the spraying position P1 and suction position P2 are positions on the top of the mesh disc 31 as seen in the figure. More specifically, the spraying position P1 and suction position P2 are both offset to one side from the axis of rotation O. As a result, the arc of processing feedstock MC movement has a center angle Z with its origin at the axis of rotation O exceeding 180 degrees, and the path of the processing feedstock MC is greater than half of one full rotation of the mesh disc 31. In other words, the range of travel of the processing feedstock MC from spraying position P1 to suction position P2 is designed to be as long as possible on a mesh disc 31 that rotates on an axis of rotation O.

As described above, the classifier 30 supplies humidified air from the wetting device 202 to the space enclosing the mesh disc 31. As a result, while moving from the spraying position P1 to the suction position P2, the moisture content of the processing feedstock MC is adjusted by exposure to the humidified air. As the distance from the spraying position P1 to the suction position P2 increases, the time the processing feedstock MC is exposed to the humidified air increases, and the processing feedstock MC can be more effectively wetted (moisture content adjusted). As a result, this humidification can effectively suppress the effects of static electricity.

As shown in FIG. 4, the opening of the suction conduit 37 is larger than the opening of the defibrated material spray nozzle 33, and the opening of the suction conduit 37 covers an area greater than the area of the opening of the defibrated material spray nozzle 33. The greater part, and preferably substantially all, of the air current whereby the defibrated material spray nozzle 33 sprays the defibrated material MB flows into the opening of the suction conduit 37 when the processing feedstock MC is not present.

In the configuration shown in FIG. 4, waste D is suctioned with the air current into the suction conduit 37. As a result, waste D that passes through the mesh disc 31 is recovered by the air current from the defibrated material spray nozzle 33 without being dispersed outside of the suction conduit 37.

The classifier 30 discharges the air current supplied through a conduit 4 with the waste D suctioned through the suction conduit 37 to the conduit 29, and the air current suctioned through the recovery conduit 35 is conveyed to the mixing device 50. In other words, the air flowing from the conduit 4 to the classifier 30 is not conveyed to the mixing device 50, and new air suctioned from the classifier 30 is conveyed to the mixing device 50. With this configuration, air containing the heat produced by the defibrator 20 is not conveyed to the mixing device 50, and instead is discharged to the conduit 29. As a result, the classifier 30 also has the effect of dissipating heat produced by the defibration process unit 101, which includes the defibrator 20.

In the operation of the classifier 30, the process of spraying defibrated material MB by the defibrated material spray nozzle 33 is an example of a first spraying process, and the process of selection (separation) by the mesh disc 31 is an example of a first selection process (first separation process). The process of suctioning waste D by the recovery conduit 35 is an example of a first suction process, and the process of suctioning processing feedstock MC by the suction conduit 37 is an example of a second suction process. The process of recovering waste D by the dust collector 27 is an example of a first recovery process.

As described above, a sheet manufacturing apparatus 100 according to the first embodiment of the invention has a classifier 30. The classifier 30 has a mesh disc 31 that has multiple holes 31A formed therein and is configured to separate waste D, which is material that passes through the holes 31A, from processing feedstock MC, which is the remaining material that does not pass through the holes 31A.

The classifier 30 also has a defibrated material spray nozzle 33, which is disposed on one side (the front side FS) of the mesh disc 31, and sprays defibrated material MB, which is material including fiber to be separated, from the one side onto the mesh disc 31.

The classifier 30 also has a suction conduit 37, which is disposed on the other side (the back side BS) of the mesh disc 31, and suctions the waste D that passes through the holes 31A.

The classifier 30 also has a recovery conduit 35, which is disposed on one side (the front side FS) of the mesh disc 31, and suctions processing feedstock MC, which is the material that does not pass through the holes 31A and remains on the mesh disc 31, from the one side of the mesh disc 31.

The mesh disc 31 can rotate on its axis of rotation O. More specifically, the holes 31A can move from a spraying position P1 opposite the defibrated material spray nozzle 33 to a suction position P2 opposite the recovery conduit 35. At the suction position P2, the recovery conduit 35 suctions the processing feedstock MC that was deposited at the spraying position P1.

This configuration suctions the waste D that passes through the holes 31A in the mesh disc 31 through the suction conduit 37. By the holes 31A of the mesh disc 31 then moving, the processing feedstock MC that does not pass through the holes 31A of the mesh disc 31 and remains on the mesh disc 31 is suctioned through the recovery conduit 35 at a different position than the suction conduit 37. As a result, of the components contained in the defibrated material MB, waste D that passes through the holes 31A and processing feedstock MC that does not pass through the holes 31A can be reliably and efficiently separated and recovered by means of a small, simple classifier 30.

The classifier 30 also has a wetting device 202 that supplies humidified (wet) air to the space enclosing the mesh disc 31. As a result, the moisture content of the processing feedstock MC and waste D can be adjusted by the humidified air supplied by the wetting device 202, and the effect of static electricity can be suppressed. For example, accretion of processing feedstock MC and waste D can be prevented, and recovery and conveyance of the processing feedstock MC can be stabilized.

The mesh disc 31 is a flat disc that rotates, and the spraying position P1 and suction position P2 are both offset to one side from the axis of rotation O of the mesh disc 31.

As a result, the distance the processing feedstock MC left on the classifier 30 travels from the spraying position P1 to the suction position P2 can be made greater than half of one rotation of the classifier 30 in the direction of rotation C1. As a result, sufficient time can be assured to desirably wet the processing feedstock MC remaining on the classifier 30, and the effects of static electricity can be more effectively suppressed.

The defibrated material spray nozzle 33 and suction conduit 37 of the classifier 30 are disposed opposite each other with the mesh disc 31 therebetween, and the opening of the suction conduit 37 to the mesh disc 31 is larger than the opening of the defibrated material spray nozzle 33 to the mesh disc 31. As a result, most waste D passing through the holes 31A in the mesh disc 31 can be suctioned through the suction conduit 37, the amount of waste D that is not removed by the suction conduit 37 can be suppressed, and dispersion of waste D can be suppressed.

The sheet manufacturing apparatus 100 having the classifier 30 also has a defibrator 20 for defibrating feedstock containing fiber, and the classifier 30 separates processing feedstock MC from the defibrated material defibrated (produced) by the defibrator 20. The sheet manufacturing apparatus 100 also has a recycling unit 102 for forming the processing feedstock MC separated by the classifier 30 into sheets.

The classifier 30 efficiently separates the defibrated material MB into waste D that passes through the holes 31A in the mesh disc 31, and processing feedstock MC that does not pass through the holes 31A, and recovers the processing feedstock MC. As a result, the processing feedstock MC used to make sheets S can be reliably extracted from the defibrated material MB by a compactly configurable classifier 30 and recovered, and used to make sheets S.

2. Embodiment 2

Figure 5:
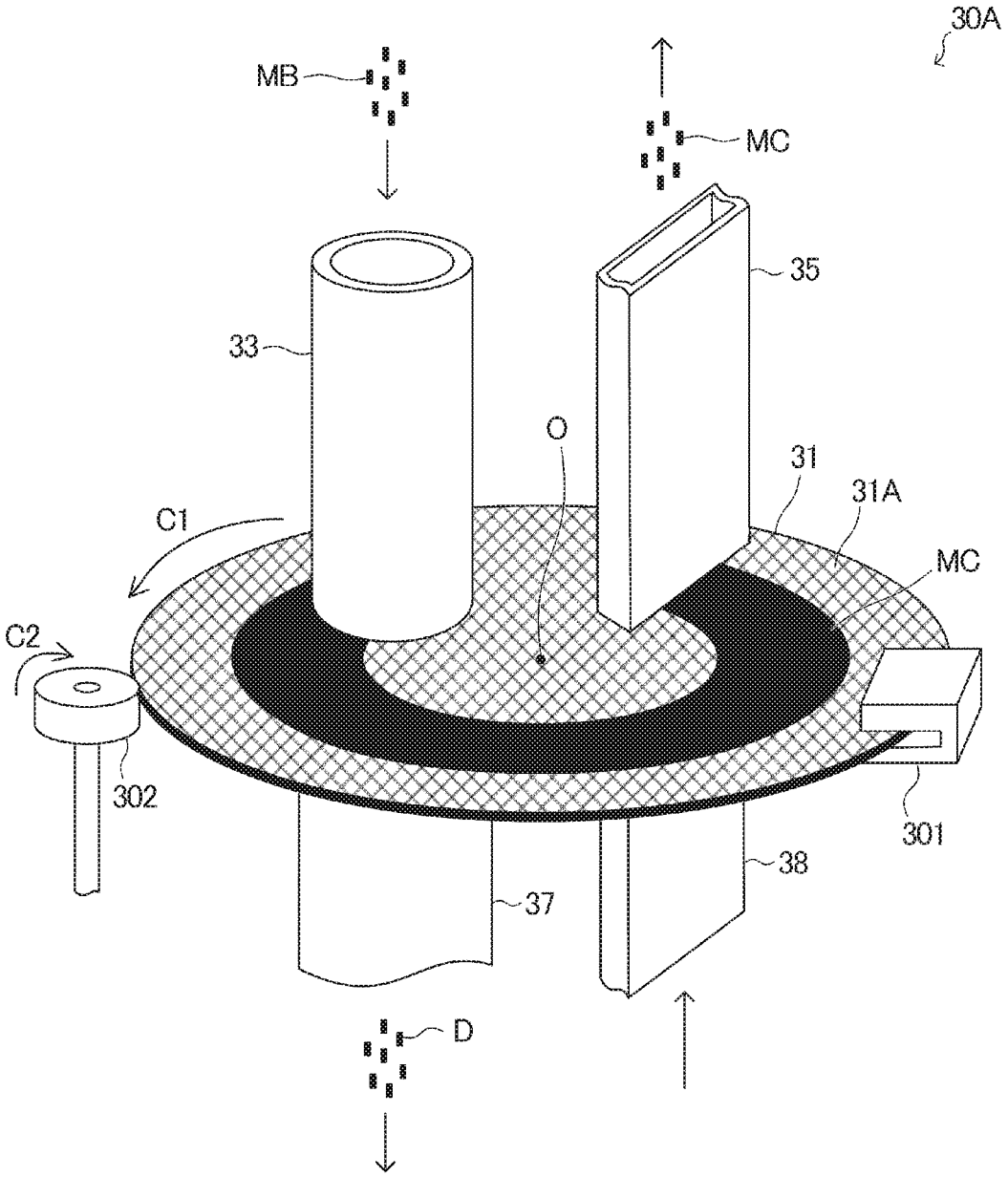
FIG. 5 is an oblique view of the main parts of the classifier in the second embodiment of the invention.

A second embodiment of the invention is described next. FIG. 5 is an oblique view showing main parts of a classifier 30A according to the second embodiment of the invention.

Figure 6:
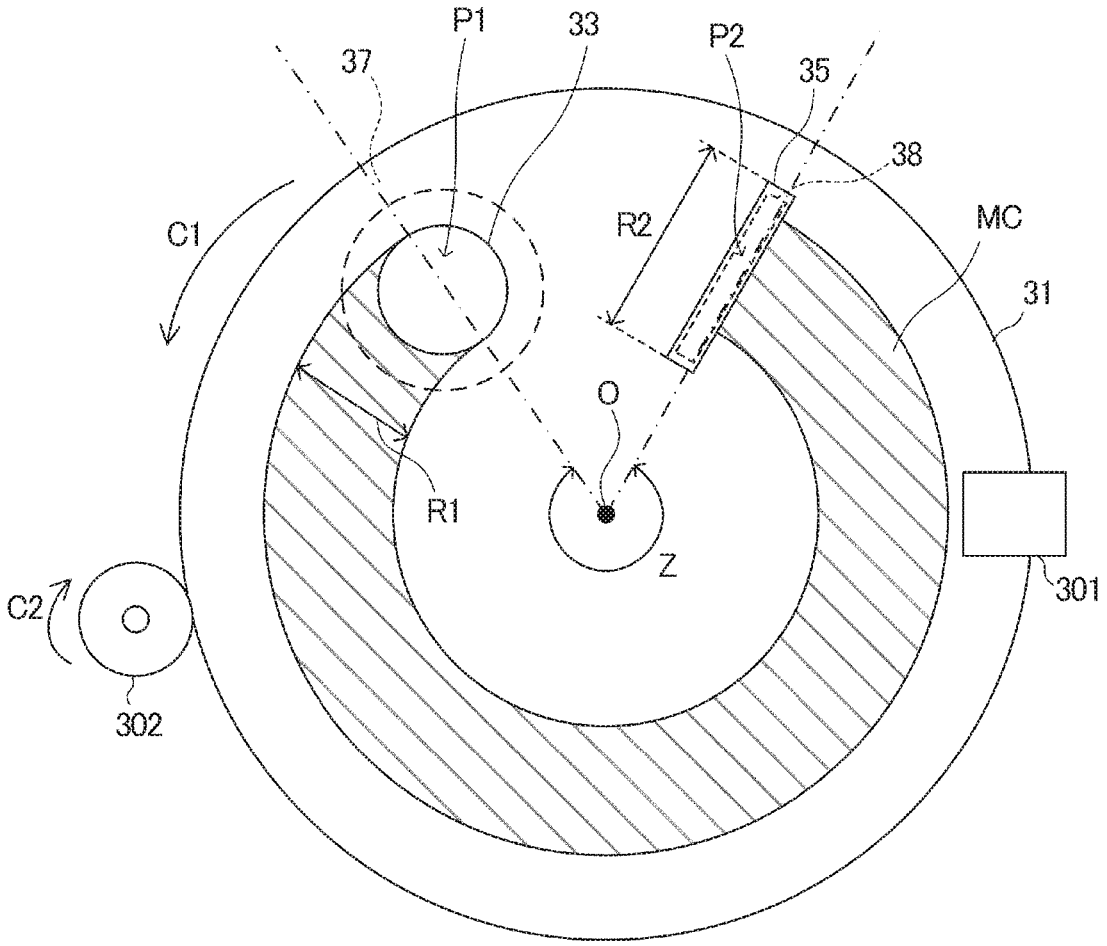
FIG. 6 is a plan view of the main parts of the classifier in the second embodiment of the invention.

FIG. 6 is a plan view of main parts of the classifier 30A as seen from the front side FS of the mesh disc 31.

Note that like parts in this embodiment and the first embodiment described above are identified by like reference numerals, and further description thereof is omitted or simplified.

The classifier 30A (separating device) is disposed to the sheet manufacturing apparatus 100 instead of the classifier 30 described in the first embodiment. Like the classifier 30, the classifier 30A has a mesh disc 31, defibrated material spray nozzle 33, recovery conduit 35, suction conduit 37, support member 301, and driver 302.

In addition, the classifier 30A has a humidified air supply conduit 38 (second spraying unit) disposed to the back side BS of the mesh disc 31. The humidified air supply conduit 38 is a hollow tube for supplying humidified air (moisturized air) produced by a heaterless humidifier similar to the wetting device 202 (FIG. 1) described above. Although the expressions 'spray' and 'spraying' are used in this specification in connection with humidified air, this does not imply any more than that humidified air is blown or otherwise supplied and should not be taken to require that droplets of water of any particular size are sprayed. Optionally, the wetting device 202 may be omitted. Also optionally, the air supplied by the supply conduit 38 need not be humidified. This is also the case with other supply conduits discussed below.

The humidified air supply conduit 38 is disposed to a position opposite the open end 35A of the recovery conduit 35 with the mesh disc 31 therebetween. The humidified air supply conduit 38 sprays (blow or otherwise supplies) humidified air from the back side BS of the mesh disc 31, and this humidified air is suctioned through the recovery conduit 35.

As shown in FIG. 6, the opening of the humidified air supply conduit 38 is smaller than the opening of the recovery conduit 35. In other words, the opening of the recovery conduit 35 is larger than the opening to the humidified air supply conduit 38, and the opening of the recovery conduit 35 is configured to cover an area including the opening to the humidified air supply conduit 38. As a result, the greater part, and preferably substantially all, of the current of humidified air output by the humidified air supply conduit 38 flows into the opening of the recovery conduit 35 with the processing feedstock MC. The processing feedstock MC is therefore not dispersed outside of the recovery conduit 35 by the current of humidified air supplied by the humidified air supply conduit 38, and the processing feedstock MC can be more reliably recovered.

The humidified air supply conduit 38 may be configured to receive a supply of humidified air from a heaterless humidifier of the sheet manufacturing apparatus 100 other than wetting device 202. In this case, the sheet manufacturing apparatus 100 has a heaterless humidifier configured the same as the wetting device 202 in addition wetting devices 202 and 208. Alternatively, the conduit (not shown in the figure) that carries humidified air from the wetting device 202 to the space including the mesh disc 31 may be configured to branch and also supply humidified air to the humidified air supply conduit 38.

The classifier 30A may also be a configuration that omits the wetting device 202 (see FIG. 1) of the classifier 30. Further alternatively, a configuration that humidifies the space including the mesh disc 31 by the wetting device 202 as described in the classifier 30 of the first embodiment, and also supplies humidified air through the humidified air supply conduit 38 from the heaterless humidifier, is also conceivable.

The classifier 30A in this embodiment thus has a humidified air supply conduit 38 that is disposed on the back side BS of the mesh disc 31 and sprays, blows or otherwise supplies humidified air to the processing feedstock MC suctioned by the recovery conduit 35. As a result, the moisture content of the processing feedstock MC the recovery conduit 35 suctions can be adjusted to prevent accretion of processing feedstock MC due to static electricity, and stably recover and convey the processing feedstock MC.

In the operation of the classifier 30A, the process of supplying (for example, blowing) humidified air by the humidified air supply conduit 38 is an example of a second spraying process.

In addition, the classifier 30A suctions and conveys to the mixing device 50 through the recovery conduit 35 air supplied from the humidified air supply conduit 38. In other words, air supplied through the humidified air supply conduit 38 is sent to the mixing device 50 without sending the air flowing through the conduit 4 to the classifier 30. This configuration enables discharging the air current containing heat produced by the defibrator 20 from the conduit 29 instead of feeding the heated air to the mixing device 50. In addition, humidified air can be supplied to the mixing device 50. By the classifier 30 venting heat produced by the defibration process unit 101 including the defibrator 20, and sending humidified air and desirably wetted processing feedstock MC to the mixing device 50, this configuration has the effect of simplifying processing in the recycling unit 102.

3. Embodiment 3

A third embodiment of the invention is described next.

Figure 7:
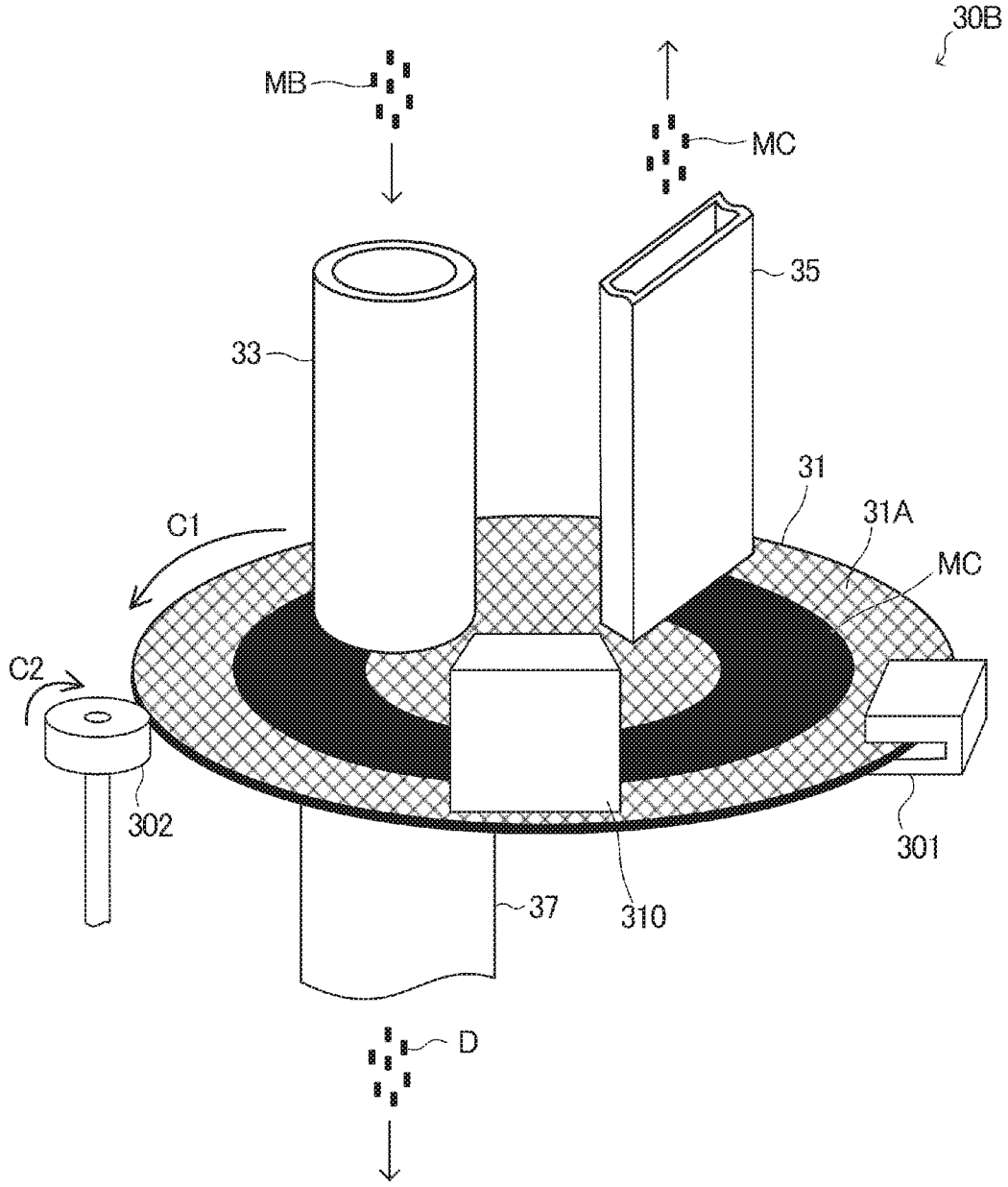
FIG. 7 is an oblique view of the main parts of the classifier in the third embodiment of the invention.
Figure 8:
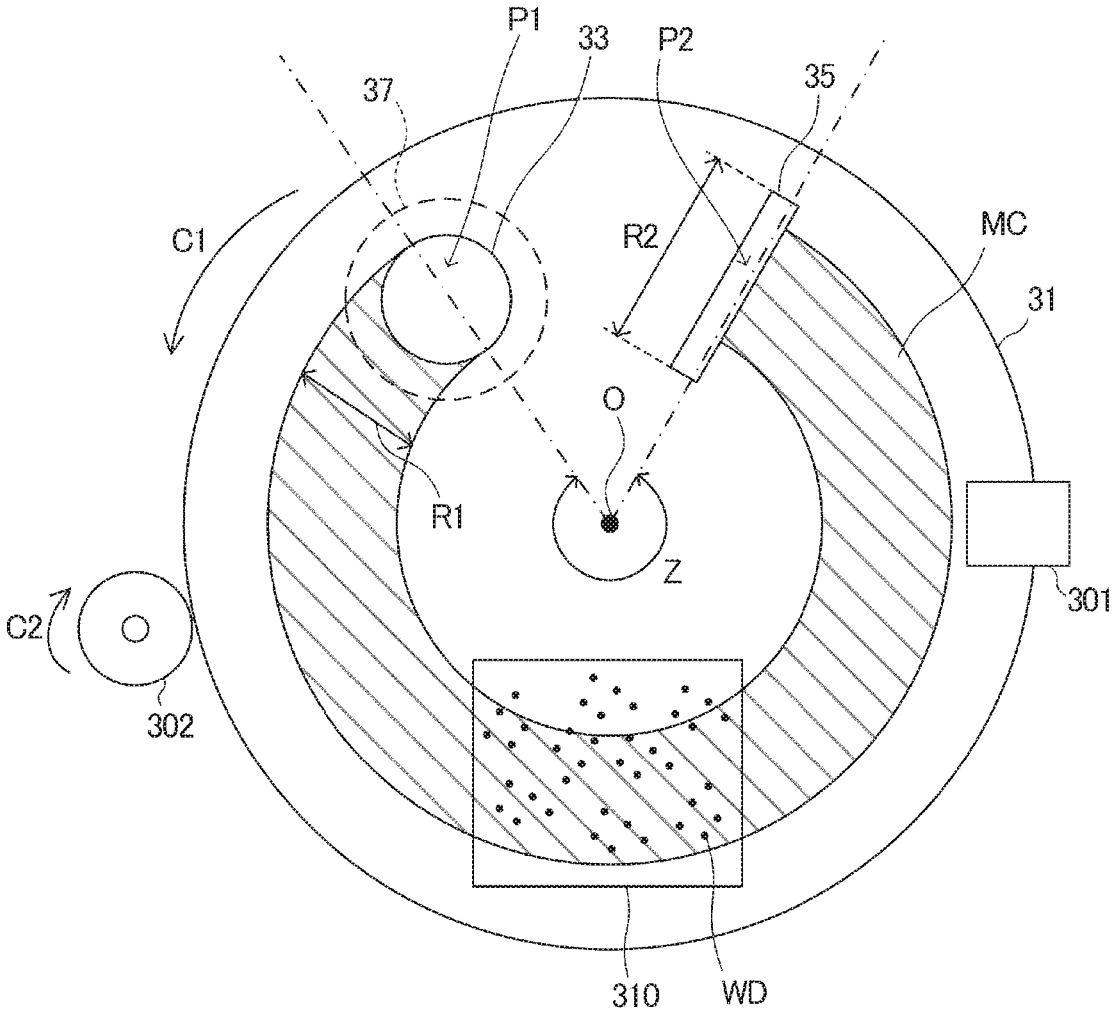
FIG. 8 is a plan view of the main parts of the classifier in the third embodiment of the invention.

FIG. 7 is an oblique view of the main parts of the classifier 30B in the third embodiment of the invention. FIG. 8 is a plan view of the main parts of the classifier 30B as seen from the front side FS of the mesh disc 31.

Note that like parts in this embodiment and the first embodiment described above are identified by like reference numerals, and further description thereof is omitted or simplified.

The classifier 30B (separating device) is disposed to the sheet manufacturing apparatus 100 instead of the classifier 30 described in the first embodiment. Like the classifier 30 described above, this classifier 30B has a mesh disc 31, defibrated material spray nozzle 33, recovery conduit 35, suction conduit 37, support member 301, and driver 302.

The classifier 30B also has a mist supplier 310 on the front side FS of the mesh disc 31. The mist supplier 310 has a box-like housing, and a generator (not shown in the figure) for dispersing water by means of an ultrasonic vibrator, for example, to produce fine water droplets WD (mist). The generator not shown may alternatively heat water to make steam (water vapor), and produce water droplets WD on the inside of the housing by condensation of the steam (water vapor). The mist supplier 310 is a humidifier that disperses water droplets WD inside the housing, causing the water droplets WD to precipitate from above onto the mesh disc 31.

The housing of the mist supplier 310 is located between the spraying position P1 and suction position P2 on the path the processing feedstock MC is carried on the mesh disc 31, and causes the water droplets WD to precipitate onto the processing feedstock MC at this position.

The classifier 30B may be configured without the wetting device 202 of the classifier 30 (see FIG. 1). Alternatively, the space containing the mesh disc 31 may be humidified by the wetting device 202 as in the classifier 30 described above, and the processing feedstock MC may be additionally wetted (humidified) by the mist supplier 310.

Further alternatively, a suction tube may be disposed on the opposite side of the mesh disc 31 as the mist supplier 310, and mist may be supplied by suctioning the mist with air through the processing feedstock MC. By pulling mist through the processing feedstock MC, more mist can be applied to the feedstock.

The mist supplier 310 is another example of a humidifier or wetting device. The humidified air supply conduit 38 may be referred to as a first humidification unit, in which case the mist supplier 310 may be referred to as a second humidification unit. Optionally, both the first and second humidification units may be provided.

In the operation of the classifier 30B, the process of supplying water droplets WD by the mist supplier 310 is an example of a humidification process. The process of supplying humidified air by the humidified air supply conduit 38 may be called a first humidifying process instead of a second spraying process, in which case the process of supplying water droplets WD by the mist supplier 310 may be referred to as second humidifying process.

By having a mist supplier 310 for wetting the mesh disc 31 between the spraying position P1 and suction position P2, the classifier 30B can, by controlling production of the water droplets WD (mist), adjust the moisture content of the processing feedstock MC that does not pass through the holes 31A in the mesh disc 31 at the spraying position P1 and is suctioned at the suction position P2. By moistening (adjusting the moisture content) of the processing feedstock MC before suctioning through the recovery conduit 35, the effects of static electricity on the processing feedstock MC can be suppressed. As a result, accretion of processing feedstock MC due to static electricity can be prevented, and the processing feedstock MC can be recovered more efficiently and fed to the mixing device 50.

Furthermore, because the spraying position P1 and suction position P2 are offset to one side from the axis of rotation O of the mesh disc 31, space for disposing the mist supplier 310 can be easily assured. In addition, a larger area for the mist supplier 310 to supply water droplets WD to the processing feedstock MC can also be assured. As a result, the processing feedstock MC can be more effectively humidified by the mist supplier 310.

4. Embodiment 4

4-1. Configuration of a Sheet Manufacturing Apparatus

A fourth embodiment employing the invention is described next.

Figure 9:
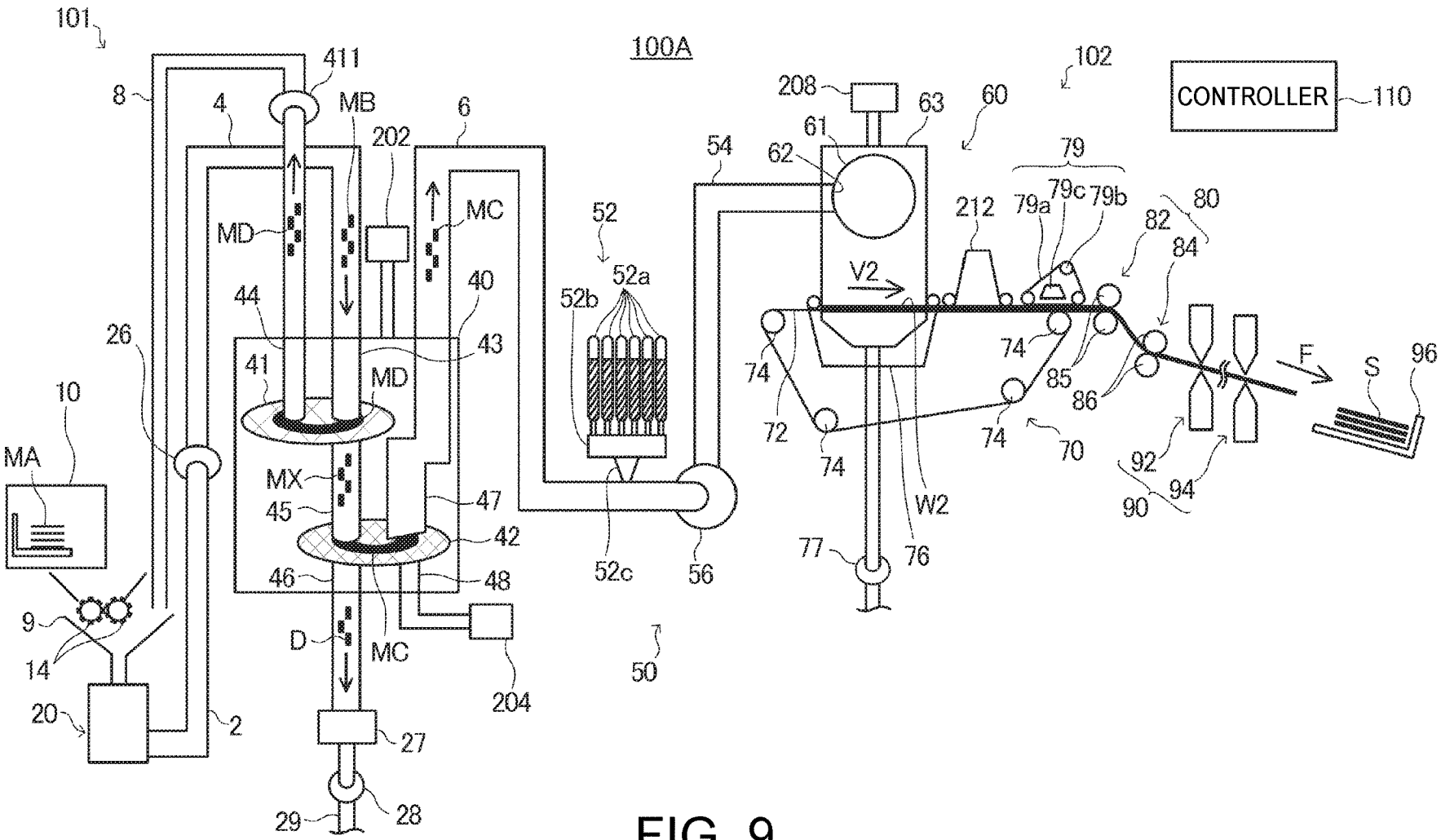
FIG. 9 illustrates the general configuration of a sheet manufacturing apparatus according to a fourth embodiment of the invention.

FIG. 9 schematically illustrates the general configuration of a sheet manufacturing apparatus 100A according to the fourth embodiment of the invention.

This sheet manufacturing apparatus 100A (fibrous feedstock recycling device) has a classifier 40 and conduit 8 instead of the classifier 30 of the sheet manufacturing apparatus 100 described in the first embodiment. The modifications in the second and third embodiments may also be made to the fourth and subsequent embodiments.

Note that like parts in this embodiment and the first embodiment described above are identified by like reference numerals, and further description thereof is omitted or simplified.

Like the sheet manufacturing apparatus 100 described above, this sheet manufacturing apparatus 100A has a defibration process unit 101 and recycling unit 102. The classifier 40 of the sheet manufacturing apparatus 100A separates processing feedstock MC that is desirable as material for the recycling unit 102 to manufacture sheets S from the other components of the defibrated material MB defibrated by the defibrator 20. The sheet manufacturing apparatus 100A uses the processing feedstock MC separated by the classifier 40 to make sheets S by the recycling unit 102.

The classifier 40 of the sheet manufacturing apparatus 100A separates and returns material in the defibrated material MB that is larger than the processing feedstock MC to the defibrator 20 for defibrating again. Material in the defibrated material MB that is smaller than the processing feedstock MC and is not suitable for making sheets S is also separated by the classifier 40 and collected by the dust collector 27 of the sheet manufacturing apparatus 100A.

The classifier 40 (separating device) classifies the defibrated material MB input through the conduit 2 by size. More specifically, the classifier 40 separates the defibrated material MB into coarse material MD that is greater than or equal to a predetermined first size, processing feedstock MC that is greater than or equal to a predetermined second size, which smaller than the first size, and waste D that is smaller than the second size. The processing feedstock MC and waste D are as described in the first embodiment described above, the processing feedstock MC is primarily fiber, and the waste D includes particles of color agents and other additives as described above, and short fibers that are not suited for recycling into new sheets S as described below, and is not used to make new sheets S. The coarse material MD contains fiber, feedstock shreds, and clumps that are larger than the processing feedstock MC and not sufficiently defibrated by the defibrator 20.

More specifically, the classifier 40 has a mesh disc 41 that has numerous holes of a specific size and functions as a screen (sieve) (first separator), and a defibrated material spray nozzle 43 (first sprayer) for spraying the defibrated material MB (defibration material) onto the mesh disc 41. Of the defibrated material MB sprayed by the defibrated material spray nozzle 43, material smaller than the holes in the mesh disc 41 passes through the holes in the mesh disc 41. Material that is larger than the holes in the mesh disc 41 cannot pass through the holes in the mesh disc 41, and is left on the mesh disc 41. These remnants include large fragments that are not suitable for making into sheets S, and are suctioned as the coarse material MD by a coarse material suction tube 44 (second suction unit).

The mesh disc 41 communicates with a conduit 8 to which a collection blower 411 is disposed. The conduit 8 is a hollow tube extending from the classifier 40 to the support port (not shown in the figure) that supplies coarse material to the defibrator 20 either directly or via the shredder. The collection blower 411 suctions and sends air from the coarse material suction tube 44 to the defibrator 20, and coarse material MD is suctioned from the mesh disc 41 to the coarse material suction tube 44 by the suction power of the collection blower 411. The suctioned coarse material MD is carried by the air current produced by the collection blower 411, and sent to the defibrator 20. The coarse material MD is then defibrated by the defibrator 20 with the shredded material from the shredder blades 14, and is fed back through the conduit 2 to the classifier 40.

The classifier 40 also has another mesh disc 42 (second separator) that classifies the mixture MX that has passed the mesh disc 41. Like the mesh disc 41, the mesh disc 42 functions as a sieve with holes of a specific size.

The classifier 40 also has a suction conduit 46 for suctioning waste D, which is material that passes through the mesh disc 42, below the mesh disc 42; and a collection conduit 47 for suctioning and recovering the processing feedstock MC, which is the material that does not pass through the holes in the mesh disc 42 and remains on the mesh disc conduit 4.

The suction conduit 46 (first suction unit) is a conduit for suctioning waste D that passes through the mesh disc 42 by means of the suction created by the collection blower 28. Because the suction conduit 46 is located at a position opposite a relay tube 45 with the mesh disc 42 therebetween, an air current is created inside the relay tube 45 in the direction of the mesh disc 42 by the suction power of the suction conduit 46. The relay tube 45 is disposed to a position opposite the defibrated material spray nozzle 43 with the mesh disc 41 therebetween. The mixture MX, which is a component of the defibrated material MB sprayed by the defibrated material spray nozzle 43 onto the mesh disc 41, passes through the mesh disc 41 with the air current, is suctioned by the relay tube 45, and sprayed onto the mesh disc 42.

Of the components of the defibrated material MB, fiber and other material of a size that does not pass through the holes in the mesh disc 42 remain on the mesh disc 42. The collection conduit 47 (third suction unit) then suctions the processing feedstock MC (remaining material) left on the mesh disc 42. The collection conduit 47 communicates through conduit 6 with the mixing blower 56, and the processing feedstock MC on the mesh disc 42 is suctioned and recovered by the suction power of the mixing blower 56 through the collection conduit 47.

The defibrated material MB is thus separated by the classifier 40 into coarse material MD, processing feedstock MC, and waste D, and the processing feedstock MC is conveyed to the mixing device 50.

4-2. Classifier Configuration

Figure 10:
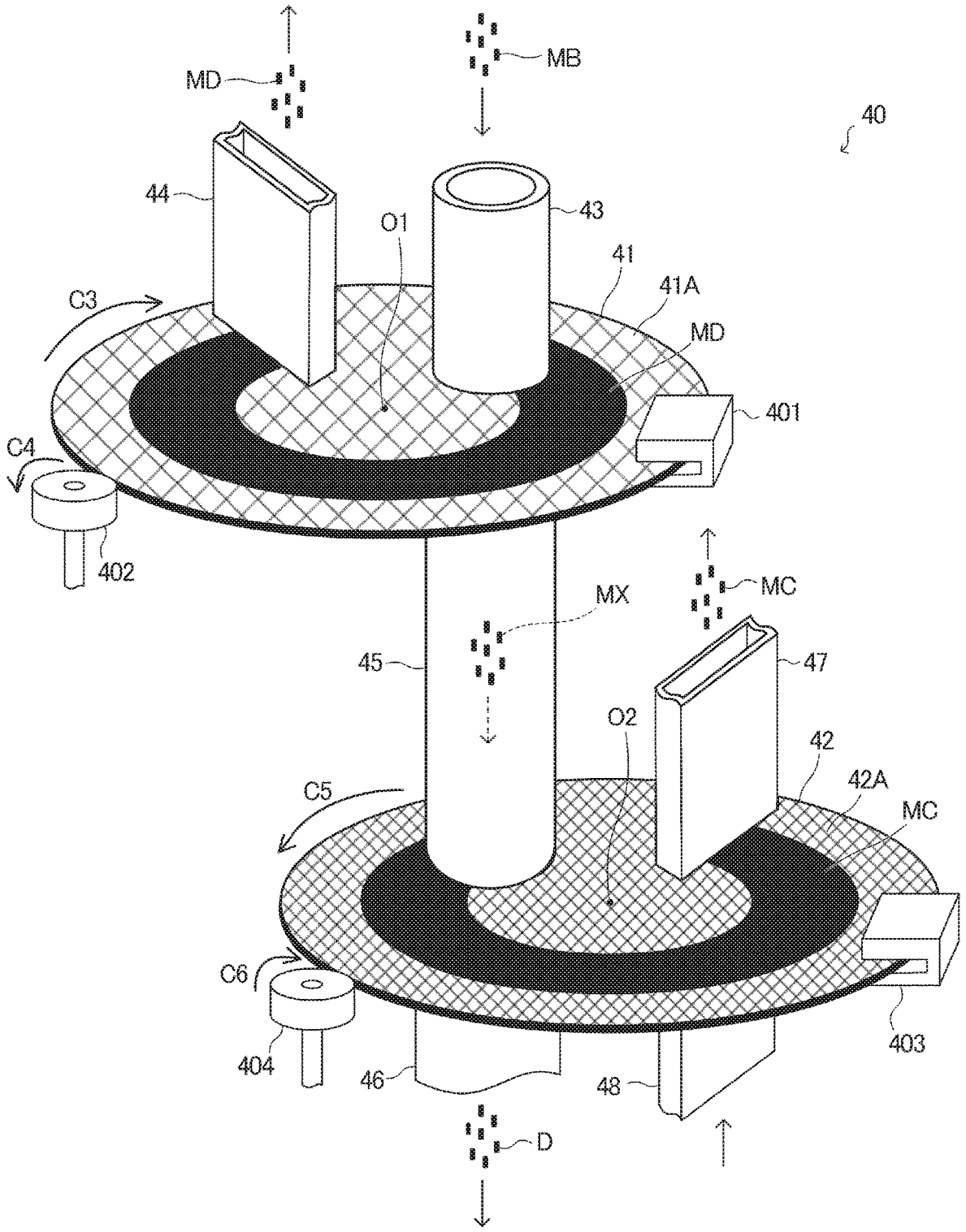
FIG. 10 is an oblique view of the main parts of the classifier in the fourth embodiment of the invention.
Figure 11:
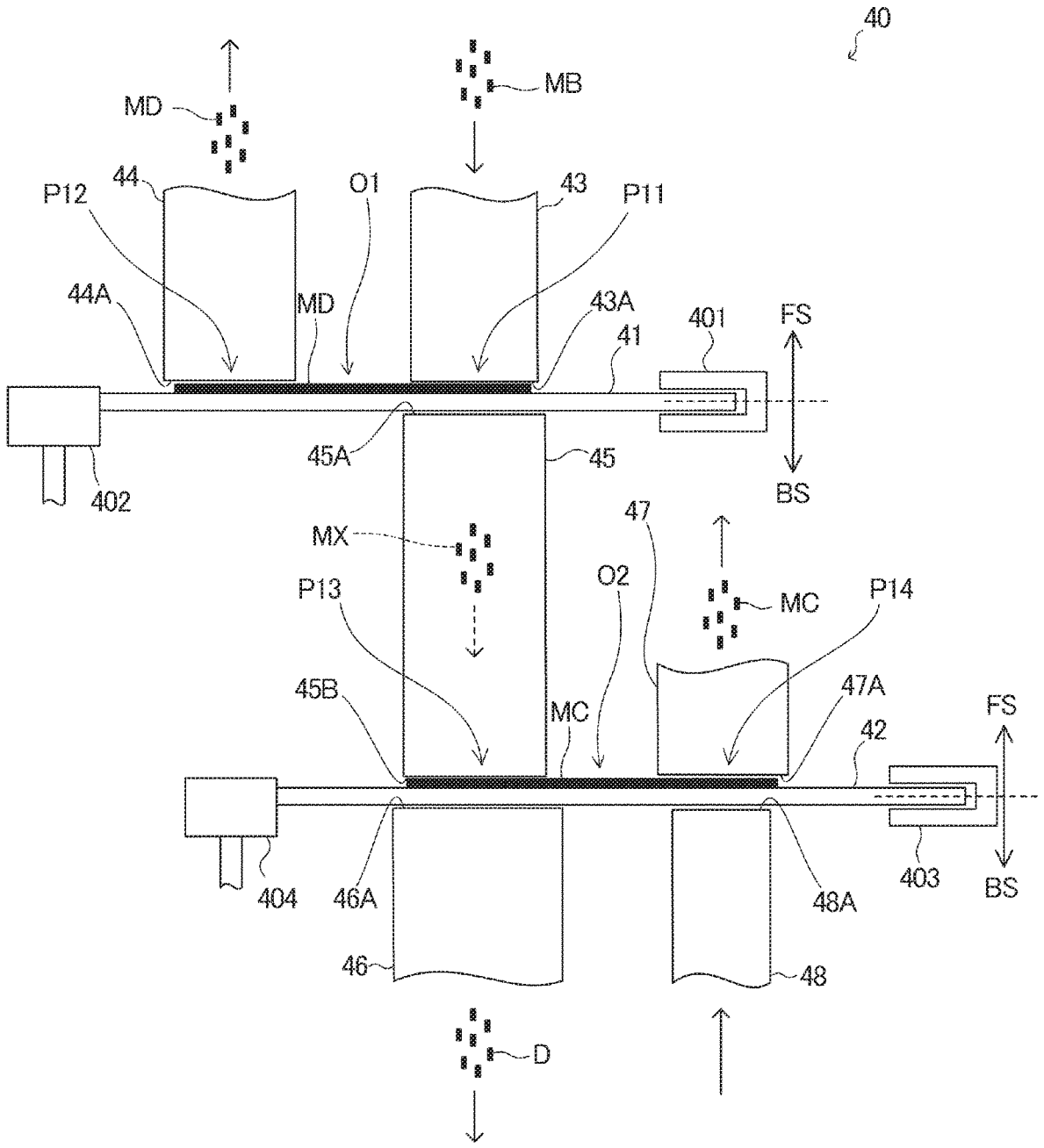
FIG. 11 is a side view of the main parts of the classifier in the fourth embodiment of the invention.
Figure 12:
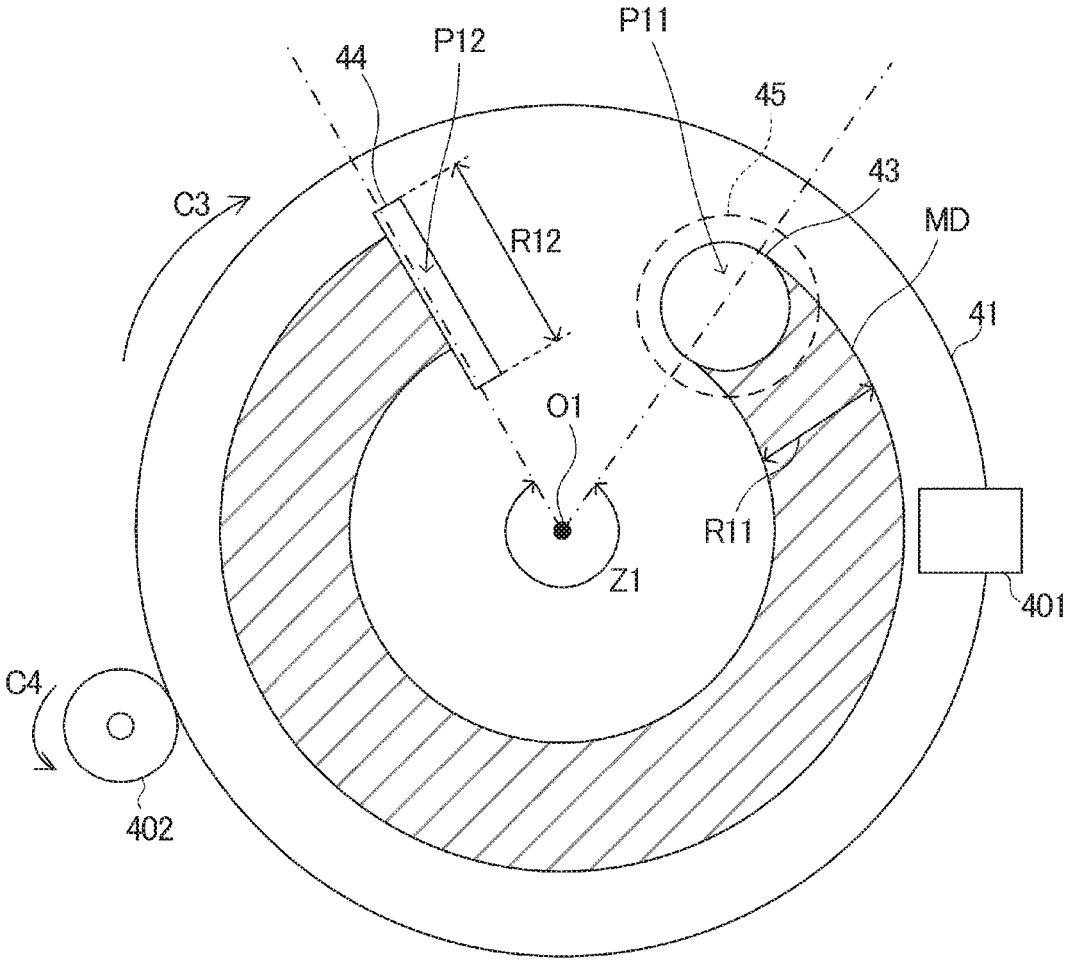
FIG. 12 is a plan view of the main parts of the classifier in the fourth embodiment of the invention.
Figure 13:
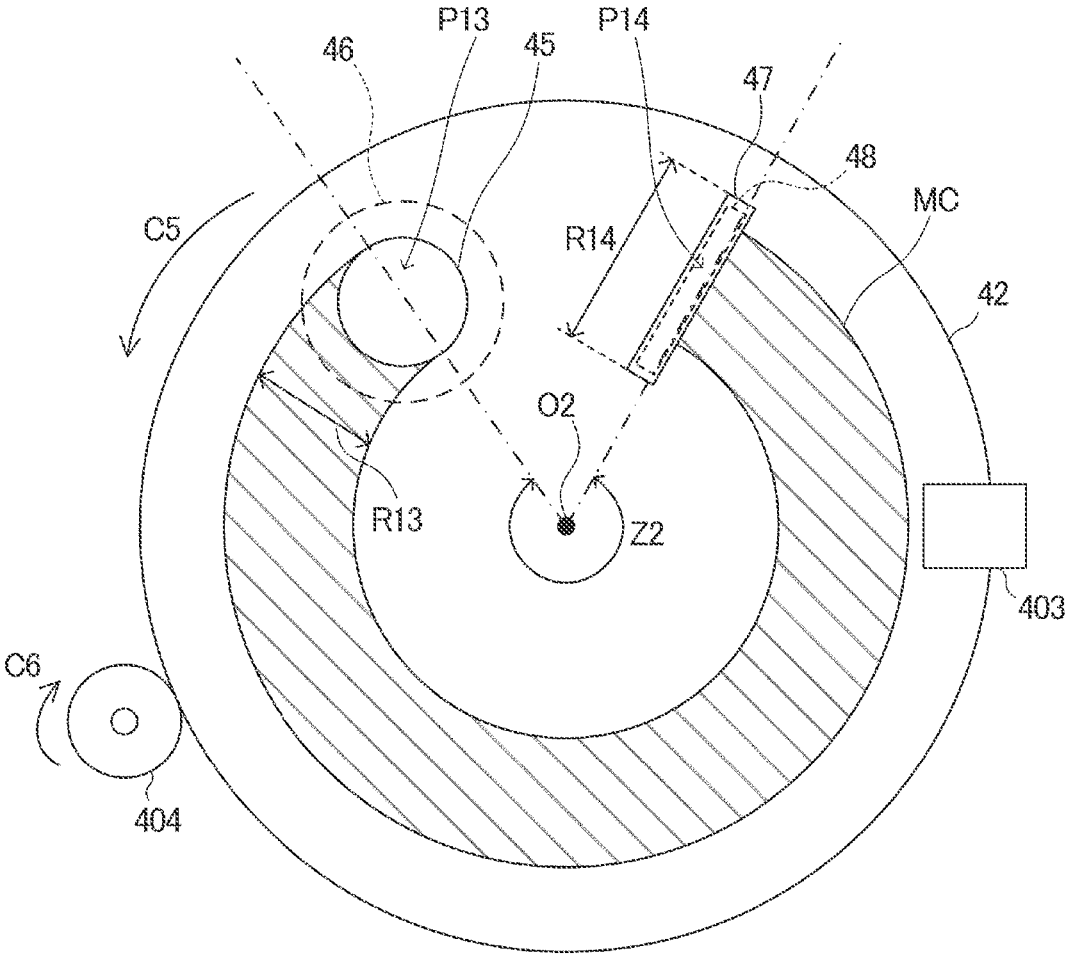
FIG. 13 is a plan view of the main parts of the classifier in the fourth embodiment of the invention.

FIG. 10 is an oblique view of the main parts of the classifier 40 according to the fourth embodiment of the invention. FIG. 11 is a side view of the main parts of the classifier 40. FIG. 12 is a plan view of the main parts of the classifier 40, showing the classifier 40 from the front side FS of the mesh disc 41. FIG. 13 is a plan view of the main parts of the classifier 40, showing the classifier 40 from the front side FS of the mesh disc 42.

As shown in FIG. 10 and FIG. 11, the mesh discs 41 and 42 are flat plate members with numerous holes 41A, 42A, and more specifically are round disc-shaped structures.

The mesh disc 41 functions as a filter or sieve with numerous holes 41A. The mesh disc 42 also functions as a filter or sieve with numerous holes 42A. Both mesh discs 41 and 42 may be configured substantially the same as the mesh disc 31 (see FIG. 2) described above.

The mesh discs 41 and 42 may be made of metal or plastic, and may be a metal screen, expanded metal made by expanding a metal sheet with slits formed therein, or punched metal having holes formed by a press in a metal sheet, for example. The shape of the mesh discs 41 and 42 is also not limited to round, and may be oval, rectangular, or other geometric shape, and may be an asymmetrical shape, but in the most typical practical configuration it is round.

The size of the holes 41A is not specifically limited, and in this example are openings of approximately 0.8 mm. This size is an example of the first size noted above. The size of the holes 42A is also not specifically limited, and in this example are openings of approximately 0.1 mm. This size is an example of the second size noted above.

The shape of the holes 41A, 42A is also not specifically limited, and the holes 41A, 42A may be openings formed as spaces between multiple wires, or holes formed in a flat panel such punched metal. The shape of the holes 41A, 42A may also be polygonal, round, or oval. The size of the holes 41A, 42A can be defined as the width of the longest part of the opening.

The mesh discs 41 and 42 may also be configured with different materials, shapes, or sizes, and the shapes of the holes 41A, 42A may also be different shapes.

The classifier 40 has a support member 401 configured to support the outside edge part of the mesh disc 41, and a driver 402 configured to contact the outside edge of the mesh disc 41 and drive the mesh disc 41.

The classifier 40 also has a support member 403 configured to support the outside edge part of the mesh disc 42, and a driver 404 configured to contact the outside edge of the mesh disc 42 and drive the mesh disc 42.

The support members 401, 403 are configured similarly to the support member 301 (see FIG. 2), and support the mesh discs 41, 42 rotatably.

The drivers 402, 404 are configured similarly to driver 302 (see FIG. 2). The drivers 402, 404 are rollers that turn in contact with the outside edge of the mesh discs 41, 42, are driven by a motor not shown, and turn in the directions indicated by arrows C4, C6.

The mesh disc 41 turns in direction of rotation C3 when the driver 402 turns. The mesh disc 42 turns in direction of rotation C5 when driver 404 turns. The rotational speed and direction of the drivers 402, 404, and the mesh discs 41, 42 may be set as desired, or controlled by the controller 110 (see FIG. 1), for example.

The mesh discs 41, 42 are disposed to be horizontal when the sheet manufacturing apparatus 100 is set up in the operating position. The mesh discs 41, 42 may, however, be disposed to any desired angle, including vertically (parallel to the vertical plane), or at a desirable angle to the level horizontal plane.

In this embodiment, the processing feedstock MC deposited on the mesh discs 41, 42 can preferably remain on the discs for a specific continuous time. As a result, the mesh discs 41, 42 in this embodiment are preferably disposed horizontally or at a nearly horizontal angle. The angle of the mesh discs 41, 42 is held constant by the support members 401, 403 supporting the mesh discs 41, 42.

The configuration that supports and rotates the mesh discs 41, 42 is not limited to a configuration with support members 401, 403 and drivers 402, 404. For example, the mesh disc 41 may be mounted with a rotating spindle passing through the axis of rotation O1, and the mesh disc 42 may be mounted with a rotating spindle passing through the axis of rotation O2, and the rotating spindles may be configured to support and drive the mesh discs 41, 42 rotationally.

The defibrated material spray nozzle 43, relay tube 45, suction conduit 46, collection conduit 47, and humidified air supply conduit 48 are disposed substantially vertically. These may be disposed at any suitable angle, but the open face of each is preferably directly facing the surface of the respective mesh disc 41 or 42.

As shown in FIG. 11, the defibrated material spray nozzle 43 and coarse material suction tube 44 are disposed to the front side FS of the mesh disc 41, and the relay tube 45 is disposed to the back side BS of the mesh disc 41. Note that if the front side FS is one side of the mesh disc 41, the back side BS is the other side. The relay tube 45 and collection conduit 47 are disposed to the front side FS of the mesh disc 42, and the suction conduit 46 and humidified air supply conduit 48 are disposed to the back side BS.

The defibrated material spray nozzle 43 is a hollow tube, and is configured substantially like the defibrated material spray nozzle 33 described above (see FIG. 2). The open end 43A at the bottom end of the defibrated material spray nozzle 43 is disposed facing the surface of the mesh disc 41.

The collection conduit 47 is a hollow tube configured like the recovery conduit 35 (see FIG. 2), and the suction conduit 46 is a hollow tube configured like the suction conduit 37 described above. The open end 46A at the top end of the suction conduit 46, and the open end 47A at the bottom end of the collection conduit 47, are disposed facing the surface of the mesh disc 42.

The coarse material suction tube 44 is also a hollow tube, and the space inside the coarse material suction tube 44 opens at the open end 44A at the bottom end of the coarse material suction tube 44. This open end 44A opposes the front side FS of the mesh disc 41.

As shown in FIG. 9, the relay tube 45 is disposed between the mesh disc 41 and mesh disc 42. The top open end 45A of the relay tube 45 is disposed opposite the open end 43A of the defibrated material spray nozzle 43 with mesh disc 41 therebetween. The bottom open end 45B of the relay tube 45 is disposed opposite the open end 46A of the suction conduit 46 with mesh disc 42 therebetween.

The humidified air supply conduit 48 (second spraying unit), which is optional, is disposed to a position opposite the open end 47A of the collection conduit 47 with the mesh disc 42 therebetween. The humidified air supply conduit 48 sprays (blows/supplies) humidified air from the back side BS of the mesh disc 42, and this humidified air is suctioned by the collection conduit 47.

Of the components of the defibrated material MB the defibrated material spray nozzle 43 sprays onto the mesh disc 41, fiber and other material that does not pass through the holes 41A accumulates on the front side FS of the mesh disc 41. This accumulated material is referred to as coarse material MD. The coarse material MD sticks to the mesh disc 41 directly below the open end 43A, and moves in direction of rotation C3 as the mesh disc 41 turns. The coarse material MD accumulated on the mesh disc 41 is then suctioned through the coarse material suction tube 44 by the suction power of the collection blower 411.

The configuration of the mesh disc 41 and surroundings is described next.

As shown in FIG. 10, FIG. 11, and FIG. 12, the defibrated material spray nozzle 43 and coarse material suction tube 44 are disposed at different positions above the mesh disc 41. The coarse material MD sprayed from the open end 43A onto the mesh disc 41 moves in an arc in conjunction with rotation of the mesh disc 41. Open end 44A is open to the path of coarse material MD travel, and the coarse material MD carried on the mesh disc 41 is suctioned through the coarse material suction tube 44 by means of the suction produced by the collection blower 411 (FIG. 9).

The position of the open end 43A relative to the mesh disc 41, that is, the location to which the defibrated material spray nozzle 43 deposits the defibrated material MB, is referred to as spraying position P11 (first position).

The position of the open end 44A relative to the mesh disc 41, that is, the location where the coarse material MD is suctioned through the coarse material suction tube 44, is referred to as suction position P12 (second position).

Because the spraying position P11 and suction position P12 are at different locations on the path the mesh disc 41 moves when turning, the coarse material MD deposited on the mesh disc 41 at the spraying position P11 moves in an arc to the suction position P12 as the mesh disc 41 turns.

As shown in FIG. 10 and FIG. 12, the path of coarse material MD movement is an arc centered on the axis of rotation O1 and starting from the spraying position P11. The suction position P12 is another position on the arc of coarse material MD movement. The distance from the axis of rotation O1 to the spraying position P11 is therefore substantially equal to the distance from the axis of rotation O1 to the suction position P12. In other words, the spraying position P11 and the suction position P12 are both located in respective radii of the mesh disc 41, and the distances thereto from the axis of rotation O1 of the mesh disc 41 are substantially equal.

In this example, the distance from the axis of rotation O1 to the spraying position P11 may be defined as the distance from the axis of rotation O1 to the center of the spraying position P11. Likewise, the distance from the axis of rotation O1 to the suction position P12 may be defined as the distance from the axis of rotation O1 to the center of the suction position P12.

The width of the path of coarse material MD movement in the radial direction of the circle centered on the axis of rotation O1 is width R11. This width R11 is equivalent to the open width of the open end 43A of the defibrated material spray nozzle 43. Because the defibrated material spray nozzle 43 in this embodiment is described as a round tube, the shape of the opening of the open end 43A is also round. In other examples, the shape of the opening of the open end 43A may be polygonal or elliptical, in which case the opening is preferably largest in the circumferential direction centered on the axis of rotation O1. In this case, coarse material MD and waste D can be more reliably separated by dispersing the defibrated material MB over a wide area of the mesh disc 41.

The opening of the coarse material suction tube 44 has an open width R12 that is greater than width R11 in the radial direction of a circle centered on the axis of rotation O1. The opening to the coarse material suction tube 44 in this example is rectangular with width R12 being the long side, but the shape of the opening to the coarse material suction tube 44 is not specifically limited, and may be round, elliptical, or polygonal. The opening of the coarse material suction tube 44 preferably assures a large open width R12 and a small open area. As a result, the shape of the open end 44A is preferably a rectangle with a long side of width R12, or an ellipse with a long diameter of width R12. The open area of the coarse material suction tube 44 affects the speed of the suction current through the opening to the coarse material suction tube 44. In other words, if the open area is small, the speed of the air current through the open end 44A is fast. Therefore, by decreasing the open area of the coarse material suction tube 44, the speed of the suction current pulling the coarse material MD from the mesh disc 41 can be increased, and the coarse material MD can be reliably suctioned and recovered without leaving material on the mesh disc 41.

As shown in FIG. 12, both the spraying position P11 and suction position P12 are positions offset to one side from the axis of rotation O1 of the mesh disc 41. As a result, the arc of coarse material MD movement has a center angle Z1 with its origin at the axis of rotation O1 exceeding 180 degrees, and the path of the coarse material MD is greater than half of one full rotation of the mesh disc 41. In other words, the range of travel of the coarse material MD from spraying position P11 to suction position P12 is designed to be as long as possible on a mesh disc 41 that rotates on an axis of rotation O1.

The classifier 40 supplies humidified air from the wetting device 202 to the space enclosing the mesh disc 41. As a result, while moving from the spraying position P11 to the suction position P12, the moisture content of the coarse material MD is adjusted by exposure to the humidified air. As the distance from the spraying position P11 to the suction position P12 increases, the time the coarse material MD is exposed to the humidified air increases, and the coarse material MD can be more effectively wetted (the moisture content can be adjusted). As a result, this humidification process can effectively suppress the effects of static electricity.

As shown in FIG. 12, the opening of the top open end 45A of the relay tube 45 is larger than the opening of the defibrated material spray nozzle 43, and covers an area greater than the area of the opening of the defibrated material spray nozzle 43. The greater part, and preferably substantially all, of the air current whereby the defibrated material spray nozzle 43 sprays the defibrated material MB flows into the opening of the relay tube 45 when the coarse material MD is not present. As a result, the air current carrying the mixture MX that has passed through the mesh disc 41 is pulled into the suction conduit 46, and dispersion of the mixture MX between mesh disc 41 and mesh disc 42 is prevented or suppressed.

The configuration of the mesh disc 42 and surroundings is described next.

As shown in FIG. 10, FIG. 11, and FIG. 13, the bottom of the relay tube 45 and the collection conduit 47 are disposed to different positions above the mesh disc 42. The processing feedstock MC sprayed from the bottom open end 45B onto the mesh disc 42 moves in an arc in conjunction with rotation of the mesh disc 42. Open end 47A is open to the path of processing feedstock MC travel, and the processing feedstock MC carried on the mesh disc 42 is suctioned through the collection conduit 47 by means of the suction produced by the mixing blower 56 (FIG. 9).

The position of the bottom open end 45B opposite the mesh disc 42, that is, the location where the mixture MX is sprayed from the relay tube 45 onto the mesh disc 42, is spraying position P13 (third position).

The position of the open end 47A relative to the mesh disc 42, that is, the location where the processing feedstock MC is suctioned through the collection conduit 47, is referred to as suction position P14 (fourth position).

Because the spraying position P13 and suction position P14 are at different locations on the path the mesh disc 42 moves when turning, the processing feedstock MC deposited on the mesh disc 42 at the spraying position P13 moves in an arc to the suction position P14 as the mesh disc 42 turns.

As shown in FIG. 10 and FIG. 12, the path of processing feedstock MC movement is an arc centered on the axis of rotation O2 and starting from the spraying position P13. The suction position P14 is another position on the arc of processing feedstock MC movement. The distance from the axis of rotation O2 to the spraying position P12 is therefore substantially equal to the distance from the axis of rotation O2 to the suction position P14. In other words, the spraying position P13 and the suction position P14 are both located in respective radii of the mesh disc 42, and the distances thereto from the axis of rotation O2 of the mesh disc 42 are substantially equal.

In this example, the distance from the axis of rotation O2 to the spraying position P13 may be defined as the distance from the axis of rotation O2 to the center of the spraying position P13. Likewise, the distance from the axis of rotation O2 to the suction position P14 may be defined as the distance from the axis of rotation O2 to the center of the suction position P14.

The width of the path of processing feedstock MC movement in the radial direction of the circle centered on the axis of rotation O2 is width R13. This width R13 is equivalent to the open width of the bottom open end 45B of the relay tube 45. Because the relay tube 45 in this embodiment is described as a round tube, the shape of the opening of the bottom open end 45B is also round. In other examples, the shape of the opening of the relay tube 45 may be polygonal or elliptical, in which case the opening is preferably largest in the circumferential direction centered on the axis of rotation O2. In this case, processing feedstock MC and waste D can be more reliably separated by dispersing the mixture MX over a wide area of the mesh disc 42.

The opening of the collection conduit 47 has an open width R14 that is greater than width R13 in the radial direction of a circle centered on the axis of rotation O2. The opening to the collection conduit 47 in this example is rectangular with width R14 being the long side, but the shape is not specifically limited, and may be round, elliptical, or polygonal. The opening of the collection conduit 47 preferably assures a large open width R14 and a small open area. As a result, the shape of the open end 47A is preferably a rectangle with a long side of width R14, or an ellipse with a long diameter of width R14. The open area of the collection conduit 47 affects the speed of the suction current through the opening to the collection conduit 47. In other words, if the open area is small, the speed of the air current through the open end 47A is fast. Therefore, by decreasing the open area of the collection conduit 47, the speed of the suction current pulling the processing feedstock MC on the mesh disc 42 can be increased, and the processing feedstock MC can be reliably suctioned and recovered without leaving material on the mesh disc 42.

As shown in FIG. 13, both the spraying position P13 and suction position P14 are positions offset to one side from the axis of rotation O2 of the mesh disc 42. As a result, the arc of processing feedstock MC movement has a center angle Z2 with its origin at the axis of rotation O2 exceeding 180 degrees, and the path of the processing feedstock MC is greater than half of one full rotation of the mesh disc 42. In other words, the range of travel of the processing feedstock MC from spraying position P13 to suction position P14 is designed to be as long as possible on a mesh disc 42 that rotates on an axis of rotation O2.

As a result, while moving from the spraying position P13 to the suction position P14, the moisture content of the processing feedstock MC is adjusted by exposure to humidified air supplied from the wetting device 202. Because the distance from the spraying position P13 to the suction position P14 is long, the time the processing feedstock MC is exposed to the humidified air increases, and the processing feedstock MC can be more effectively wetted (the moisture content can be adjusted). As a result, this humidification process can effectively suppress the effects of static electricity.

As shown in FIG. 13, the opening of the open end 46A of the suction conduit 46 is larger than the bottom open end 45B of the relay tube 45, and covers an area greater than the area of the bottom open end 45B. The greater part, and preferably substantially all, of the air current whereby the relay tube 45 sprays the mixture MX flows into the opening of the suction conduit 46 when the processing feedstock MC is not present. As a result, the air current carrying the waste D that has passed through the mesh disc 42 is pulled into the suction conduit 46, and dispersion of the waste D between mesh disc 41 and mesh disc 42 is prevented or suppressed.

The classifier 40 also has a humidified air supply conduit 48 (third spraying unit) disposed on the back side BS of the mesh disc 42. The humidified air supply conduit 48 is a hollow tube for supplying humidified air (moisturized air) produced by a wetting device 204 similar to the wetting device 202 (FIG. 1) described above.

As shown in FIG. 13, the opening of the humidified air supply conduit 48 is smaller than the opening of the collection conduit 47. More specifically, the opening of the collection conduit 47 is larger than the opening of the humidified air supply conduit 48, and covers an area greater than the area of the opening of the humidified air supply conduit 48. The greater part, and preferably substantially all, of the humidified air current the humidified air supply conduit 48 sprays (blows/supplies) against the mesh disc 42 flows into the opening of the collection conduit 47 with the processing feedstock MC. As a result, the processing feedstock MC can be more reliably collected without the processing feedstock MC being dispersed outside the collection conduit 47 by the current of humidified air supplied from the humidified air supply conduit 48.

In the operation of the classifier 40, the process of spraying defibrated material MB by the defibrated material spray nozzle 43 is an example of a first spraying process, the process of selection (separation) by mesh disc 41 is an example of a first selection process (first separation process), and the process of suctioning waste D by the suction conduit 46 is an example of a first suction process. The process of selection (separation) by mesh disc 42 is an example of a second selection process (second separation process), and the process of suctioning coarse material MD by the coarse material suction tube 44 is an example of a second suction process. The process of suctioning processing feedstock MC by the collection conduit 47 is an example of a third suction process, and the process of spraying humidified air by the humidified air supply conduit 48 is an example of a second spraying process.

As described above, a sheet manufacturing apparatus 100A according to the fourth embodiment of the invention has a classifier 40. The classifier 40 has a mesh disc 41 that has multiple holes 41A formed therein and is configured to separate a mixture MX, which is material that passes through the holes 41A, from coarse material MD, which is the remaining material that does not pass through the holes 41A.

The classifier 40 also has a defibrated material spray nozzle 43 (first sprayer), which is disposed on one side (the front side FS) of the mesh disc 41, and sprays defibrated material MB, which is material including fiber, from the one side onto the mesh disc 41.

The classifier 40 also has a suction conduit 46 (first suction unit), which is disposed on the other side (the back side BS) of the mesh disc 41, and suctions the material that passes through the holes 41A.

The classifier 40 also has a coarse material suction tube 44, which is disposed to the one side (front side FS) of the mesh disc 41, and suctions, from the one side of the mesh disc 41, coarse material MD that cannot pass through the holes 41A in the mesh disc 41 and remains on the mesh disc 41.

The mesh disc 41 can rotate so that the holes 41A can move from the spraying position P11 opposite the defibrated material spray nozzle 43 to a suction position P12 opposite the coarse material suction tube 44. At the suction position P12, the coarse material suction tube 44 suctions the coarse material MD that was deposited at the spraying position P11 and remains on the mesh disc 41.

The classifier 40 also has a mesh disc 42 that is disposed between the mesh disc 41 and the suction conduit 46, and has holes 42A that are smaller than the holes 41A in the mesh disc 41.

The classifier 40 also has a collection conduit 47 disposed to the mesh disc 42 on the opposite side (front side FS) to the side (back side BS) to which the suction conduit 46 is disposed. The mesh disc 42 can also rotate so that the holes 42A can move from the spraying position P13 opposite the suction conduit 46 to a suction position P14 opposite the collection conduit 47. At the suction position P14, the collection conduit 47 suctions the processing feedstock MC in the mixture MX that has passed through the holes 41A in the mesh disc 41 but has not passed through the holes 42A in the mesh disc 42 and remains on the mesh disc 42.

This configuration can separate and collect from the defibrated material MB material that does not pass through the holes 41A in the mesh disc 41, material that passes the holes 41A in the mesh disc 41 but does not pass through the holes 42A in the mesh disc 42, and material that passes through the holes 42A in the mesh disc 42. As a result, the components of the defibrated material MB can be separated according to size, and the different sizes of material can be efficiently and reliably collected by a compactly configurable classifier 40.

A sheet manufacturing apparatus 100A having the classifier 40 also has a defibrator 20 for defibrating feedstock containing fiber, and a recycling unit 102 for forming the processing feedstock MC separated by the classifier 40 into sheets. The classifier 40 efficiently separates the defibrated material MB into coarse material MD, waste D, and processing feedstock MC, and recovers the processing feedstock MC. As a result, processing feedstock MC used to make sheets S can be reliably separated from defibrated material MB by a compactly configurable classifier 40 and recovered, and used to make sheets.

The collection conduit 47 is disposed in the suction direction to a position not overlapping the coarse material suction tube 44. This configuration enables reliably separating and recovering material that does not pass through the holes 41A in the mesh disc 41, and material that passes through the holes 41A in the mesh disc 41 but does not pass through the holes 42A in the mesh disc 42.

The classifier 40 also has a humidified air supply conduit 48 that is disposed on the back side BS of the mesh disc 42, and sprays humidified air onto the processing feedstock MC suctioned by the collection conduit 47. As a result, the moisture content of the processing feedstock MC the collection conduit 47 suctions can be adjusted, accretion of processing feedstock MC due to static electricity, for example, can be prevented, and the processing feedstock MC can be consistently recovered and conveyed.

The humidified air supply conduit 48 and collection conduit 47 are disposed on opposite sides of the mesh disc 42, and the area of the collection conduit 47 open to the mesh disc 42 is greater than the area of the humidified air supply conduit 48 open to the mesh disc 42. This configuration enables the collection conduit 47 to suction most of the air emitted from the humidified air supply conduit 48, and the processing feedstock MC remaining on the mesh disc 42 can be efficiently recovered by the flow of air from the humidified air supply conduit 48 into the collection conduit 47. A humidified air supply conduit can be supplied opposite the coarse material suction tube 44 as well or instead. However, it is not necessary to supply a humidified air supply conduit at all. Similarly, a humidifier 310 can be supplied for either or both discs 41 and 42.

5. Embodiment 5

A fifth embodiment of the invention is described next.

Figure 14:
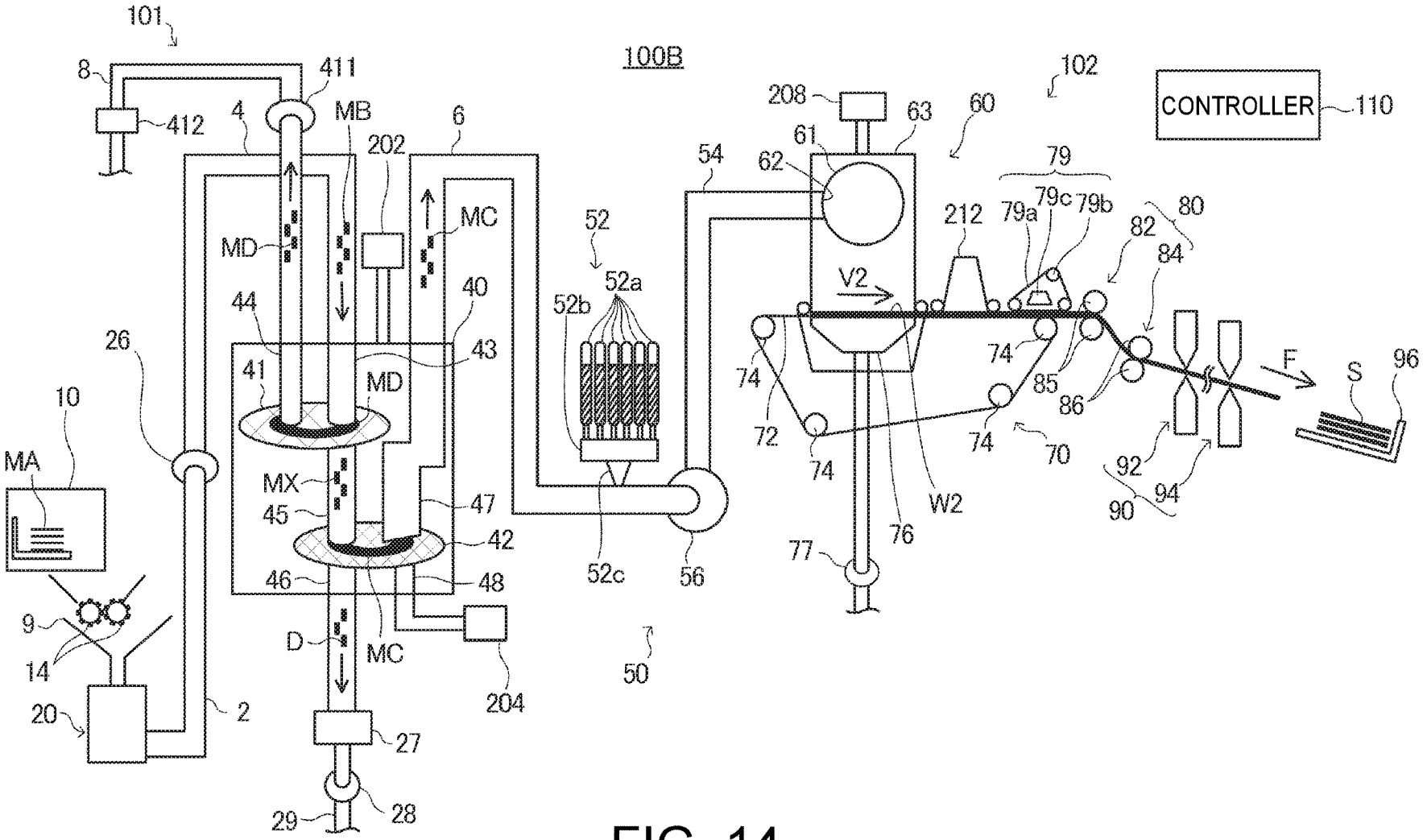
FIG. 14 illustrates the general configuration of a sheet manufacturing apparatus according to a fifth embodiment of the invention.

FIG. 14 schematically illustrates the general configuration of a sheet manufacturing apparatus 100B according to the fifth embodiment of the invention.

This sheet manufacturing apparatus 100B (fibrous feedstock recycling device) is a configuration having a recovery device 412 disposed to the conduit 8 connected to the classifier 40 of the sheet manufacturing apparatus 100A according to the fourth embodiment of the invention.

Note that like parts in this embodiment and the fourth embodiment described above are identified by like reference numerals, and further description thereof is omitted or simplified.

The sheet manufacturing apparatus 100A according to the fourth embodiment of the invention is a configuration in which coarse material MD separated by the classifier 40 is returned to the defibrator 20 through the conduit 8, and defibrated again by the defibrator 20.

The sheet manufacturing apparatus 100B according to the fifth embodiment of the invention connects a recovery device 412 to the conduit 8, and collects the coarse material MD by the recovery device 412.

Components of the defibrated material MB that are larger than the size of the processing feedstock MC include shreds produced by the shredder blades 14 that are not sufficiently defibrated by the defibrator 20. In addition, the coarse material MD may also include objects other than fiber. Examples include fragments of metal and plastic such as staples and plastic stickers attached to the feedstock MA. Such materials are unsuitable as feedstock for producing sheets S and are preferably removed, but manually removing such objects is a burden for the user. The sheet manufacturing apparatus 100B according to this embodiment is therefore configured to remove objects other than fiber by means of the recovery device 412.

In this fifth embodiment, the size of the holes 41A in the mesh disc 41 may be larger than 0.8 mm, which is the first size described above. In this case, fiber and foreign objects that are larger than components including primarily undefibrated shreds recovered by the classifier 40 of the fourth embodiment, for example, are recovered as coarse material MD.

The recovery device 412 is a filter-type or cyclonic dust collector, and has a filter (not shown in the figure) that separates coarse material MD from the air current pushed by the collection blower 411. The air that passes through the filter of the recovery device 412 is discharged to the outside, for example.

This configuration can separate by the classifier 40 and recover by the recovery device 412 foreign objects other than fiber that are not suitable for making sheets S.

The process of recovering coarse material MD by the recovery device 412 is an example of a second recovery process.

6. Other Embodiments

The embodiments described above are only examples of specific embodiments of the invention as described in the accompanying claims, do not limit the invention, and can be varied in many ways as described below without departing from the scope of the invention as described in the accompanying claims.

The foregoing embodiments describe classifiers 30, 30A, 30B having a mesh disc 31, and a classifier 40 having mesh disc 41 and mesh disc 42, but the invention is not limited to this. For example, configurations for separating (classifying) the defibrated material MB using three or more mesh discs are obviously conceivable.

In addition, the classifiers 30, 30A, 30B, 40 are not limited to being used in a sheet manufacturing apparatus 100, 100A, 100B, and can be applied to various kinds of devices that separate material to be classified into multiple parts.

A brush or other device may also be disposed in the classifiers 30, 30A, 30B, 40 described above between the surface of the mesh discs 31, 41, 42 and the open ends of the conduits. More specifically, a brush may be disposed to the distal end of the conduits disposed to the back side BS of the mesh discs 31, 41, 42. This configuration can more effectively prevent the leakage of air from between the distal ends of the conduits and the back sides BS of the mesh discs 31, 41, 42.

The classifiers 30, 30A, 30B, 40 may be configured with conduits of the desired cross sectional shape, size, length, and material, and the conduits may branch into multiple arms disposed opposite the mesh discs 31, 41, 42.

The size of the holes 31A, 41A, 42A in the mesh discs 31, 41, 42 can also be varied according to the components contained in the material to be classified, and the size of the fiber used to manufacture sheets S.

The sheet manufacturing apparatus 100, 100A, 100B is also not limited to making sheets S, and may be configured to make hard sheets, paperboard comprising multiple sheets in layers, and various other products made from a continuous web. The manufactured products are also not limited to paper, and may be nonwoven cloth.

The properties of the sheets S are also not specifically limited, and the sheets S may be paper suitable for handwriting or printing (copier paper, plain paper), wall paper, packaging paper, color paper, drawing paper, or bristol paper, for example.

If the sheet S is nonwoven cloth, the sheet S may be formed as fiber board, tissue paper, kitchen paper, vacuum filter bags, filters, liquid absorption materials, sound absorption materials, cushioning materials, or mats, for example, in addition to nonwoven cloth.

The sheet manufacturing apparatuses 100, 100A, 100B according to the foregoing embodiments describe a dry process sheet manufacturing apparatus that acquires material by defibrating feedstock in air, and manufactures sheets S using the acquired material and resin.

Application of the invention is not limited to such a device, however, and can be applied to a wet process sheet manufacturing apparatus that creates a solution or slurry of feedstock containing fiber in water or other solvent, and processes the feedstock into sheets.

The invention can also be applied to an electrostatic sheet manufacturing apparatus that causes material containing fiber defibrated in air to adhere to the surface of a drum by static electricity, for example, and then processes the feedstock adhering to the drum into sheets.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A classifying device comprising:

a first separator having multiple holes and configured to separate screenings that pass through the holes, and remnants that do not pass through the holes;

a first spraying unit disposed on one side of the first separator and configured to spray feedstock containing fiber to separate from the one side onto the first separator, the first spraying unit having a diameter R1;

a first suction unit disposed on the other side of the first separator and configured to suction the screenings that have passed through the holes;

a second suction unit disposed on the one side of the first separator, and configured to suction, from the one side of the first separator, the remnants that do not pass through the holes in the first separator and remain on the first separator, the second suction unit having a width R2, the width R2 being greater than the diameter R1, wherein:

the first separator being movably disposed so each of the holes can be repositioned from a first position opposite the first spraying unit to a second position opposite the second suction unit;

the second suction unit configured to suction at the second position the remnants left at the first position;

a second spraying unit disposed to the other side of the first separator, and configured to spray humidified air onto the remnants suctioned by the second suction unit; and a wetting device configured to supply the humidified air to the second spraying unit.

2. The classifying device described in claim 1, further comprising:

a humidified air supply device configured to supply humidified air to a space containing the first separator.

3. The classifying device described in claim 2, wherein:

the first separator is a plate member that rotates, and the first position and second position are offset to one side from an axis of rotation of the first separator.

4. The classifying device described in claim 2, further comprising:

a third spraying unit disposed to the second separator on the same side as the first suction unit, and configured to supply humidified air onto the remnants that a third suction unit suctions.

5. The classifying device described in claim 4, wherein:

the third spraying unit and the third suction unit are disposed in opposition with the second separator therebetween, and an area of an opening of the third suction unit to the surface of the second separator is greater than an area of an opening of a third sprayer to the surface of the second separator.

6. The classifying device described in claim 1, wherein:

the wetting device configured to add moisture to the first separator between the first position and the second position.

7. The classifying device described in claim 1, wherein:

the first spraying unit and the first suction unit are disposed in opposition with the first separator therebetween, and an area of an opening of the first suction unit to the surface of the first separator is greater than an area of an opening of the first spraying unit to the surface of the first separator.

8. The classifying device described in claim 1, further comprising:

a second separator disposed between the first separator and the first suction unit, and having holes smaller than the holes in the first separator; and a third suction unit disposed to the opposite side of the second separator as the first suction unit;

the second separator being movably disposed so each of the holes of the second separator can be repositioned from a third position opposite the first suction unit to a fourth position opposite the third suction unit; and the third suction unit configured to suction at the fourth position the remnants of the screenings that pass through the holes in the first separator but do not pass the holes in the second separator and are left on the second separator.

9. The classifying device described in claim 8, wherein:

the third suction unit is disposed to a position not overlapping the second suction unit in the suction direction.

10. A fibrous feedstock recycling device comprising:

a defibrator configured to defibrate feedstock containing fiber;

a classifier configured to separate processing feedstock from defibrated material that was defibrated by the defibrator; and a sheet forming unit configured to form the processing feedstock separated by the classifier into a sheet form;

the classifier including a first separator having multiple holes and configured to separate screenings that pass through the holes, and remnants that do not pass through the holes;

a first sprayer disposed on one side of the first separator and configured to spray the defibrated material from the one side onto the first separator, the first sprayer having a diameter R1;

a first suction unit disposed on the other side of the first separator and configured to suction the screenings that passed through the holes;

a second suction unit disposed on the one side of the first separator, and configured to suction, from the one side of the first separator, the remnants that do not pass through the holes in the first separator and remain on the first separator, the second suction unit having a width R2, the width R2 being greater than the diameter R1;

a second sprayer disposed to the other side of the first separator, and configured to spray humidified air onto the remnants suctioned by the second suction unit; and a wetting device configured to supply the humidified air to the second sprayer;

the first separator being movably disposed so each of the holes can be repositioned from a first position opposite the first sprayer to a second position opposite the second suction unit;

the second suction unit configured to suction at the second position the remnants left at the first position; and the fibrous feedstock recycling device conveying the remnants suctioned by the second suction unit to the sheet forming unit.

11. A classifying device comprising:

a first separator having multiple holes and configured to separate screenings of feedstock containing fiber that pass through the holes and remnants of the feedstock that do not pass through the holes;

a first sprayer disposed on one side of the first separator and configured to spray the feedstock onto the first separator, the first sprayer having a diameter R1;

a first conduit disposed on the other side of the first separator and configured to suction the screenings that passed through the holes;

a second conduit disposed on the one side of the first separator, and configured to suction, from the one side of the first separator, the remnants that do not pass through the holes in the first separator and remain on the first separator, the second conduit having a width R2, the width R2 being greater than the diameter R1;

a second sprayer disposed to the other side of the first separator, and configured to spray humidified air onto the remnants suctioned by the second conduit; and a wetting device configured to supply the humidified air to the second sprayer;

the first separator being configured to move with each of the holes movable from a first position opposite the first sprayer to a second position opposite the second conduit; and the second conduit configured to suction at the second position the remnants left at the first position and moved to the second position.

* * * * *